US007458743B2

(12) United States Patent
Smeed

(10) Patent No.: US 7,458,743 B2
(45) Date of Patent: Dec. 2, 2008

(54) CRITICAL CARE PLATFORM FOR LITTERS

(75) Inventor: Eric M Smeed, Bradenton, FL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 1050 days.

(21) Appl. No.: 10/279,926

(22) Filed: Oct. 25, 2002

(65) Prior Publication Data

US 2003/0046764 A1 Mar. 13, 2003

Related U.S. Application Data

(63) Continuation-in-part of application No. 09/961,405, filed on Sep. 25, 2001, now Pat. No. 6,493,890.

(60) Provisional application No. 60/234,760, filed on Sep. 25, 2000, provisional application No. 60/254,156, filed on Dec. 11, 2000, provisional application No. 60/282,152, filed on Apr. 9, 2001, provisional application No. 60/291,963, filed on May 21, 2001.

(51) Int. Cl.
*A47B 1/00* (2006.01)

(52) U.S. Cl. ..... 403/92; 403/68; 403/70; 403/78; 403/87; 403/91; 403/98; 5/626; 5/507.1

(58) Field of Classification Search ..... 403/68, 403/70, 78, 85, 87, 91, 92, 98, 319; 248/349.1, 248/291.1; 5/658, 626, 507.1
See application file for complete search history.

(56) References Cited

U.S. PATENT DOCUMENTS 3,427,668 A 2/1969 McManus, Jr.
4,183,110 A 1/1980 Kidd et al.
4,557,453 A * 12/1985 McCloskey ..... 248/287.1
4,691,397 A 9/1987 Netzer
4,747,172 A 5/1988 Hohol et al.
4,783,109 A 11/1988 Bucalo
5,152,486 A 10/1992 Kabanek et al.
5,160,106 A * 11/1992 Monick ..... 248/231.71

(Continued)

FOREIGN PATENT DOCUMENTS

WO WO 01/70306 9/2001

OTHER PUBLICATIONS

"Air Force Medical Equipment Development Laboratory (AFMEDL) Status Guide", printed from https://afml.ft-detrick.af.mil/afml...dl/EquipD.cfm?Equipkey=secccp%2Ehtm, Dec. 8, 2000, pp. 1-2.

(Continued)

*Primary Examiner*—Daniel P. Stodola
*Assistant Examiner*—Michael P. Ferguson
(74) *Attorney, Agent, or Firm*—Elizabeth Arwine

(57) ABSTRACT

An accessory clip for attaching medical equipment and the alike to a litter stand that is for attaching to a litter. The accessory clip preferably includes at least one attachment for a piece of medical equipment such as medical monitors, ventilators, infusion pumps, and IV bags. The accessory clip preferably includes components that allow it to be attached to the litter stand.

11 Claims, 17 Drawing Sheets

U.S. PATENT DOCUMENTS

| | | | | |
|---|---|---|---|---|
| H1328 | H | 7/1994 | Horton et al. | |
| 5,553,820 | A * | 9/1996 | Karten et al. | 248/286.1 |
| 5,626,151 | A | 5/1997 | Linden | |
| 5,845,351 | A | 12/1998 | Berta et al. | |
| 5,918,331 | A | 7/1999 | Hall et al. | |
| 5,966,760 | A * | 10/1999 | Gallant et al. | 5/658 |
| 5,975,081 | A | 11/1999 | Hood et al. | |
| 6,175,977 | B1 | 1/2001 | Schumacher et al. | |
| 6,247,674 | B1 * | 6/2001 | Jawidzik | 248/213.2 |
| 6,446,285 | B1 | 9/2002 | Chinn | |

OTHER PUBLICATIONS

"Entering a 2nd Century of Research For the Soldier," U.S. Army Medical Research and Material Command Walter Reed Army Institute of Research, pp. 14-15.

Ferno Aviation, Inc. Model 274 Pac-Rac™ web page printout dated May 8, 2000, http://aviation.ferno.com/Products/Miscellaneous/274pacrac.htm.

Ferno Aviation, Inc. Model 274 Pac-Rac Pics web page printout dated Dec. 11, 2001, http://aviation.ferno.com/products/miscellaneous/Big%20Pics/pacracpics.htm.

Ferno Aviation, Inc. Model 274 Pac-Rac Pics web page printout dated May 8, 2000, http://aviation.ferno.com/Products/Miscellaneous/Big%20Pics/Pacracpics.htm.

Ferno Aviation, Inc., pictures of Pac Rac for NATO litter delivered on or about Dec. 26, 2000.

* cited by examiner

FIG. 1
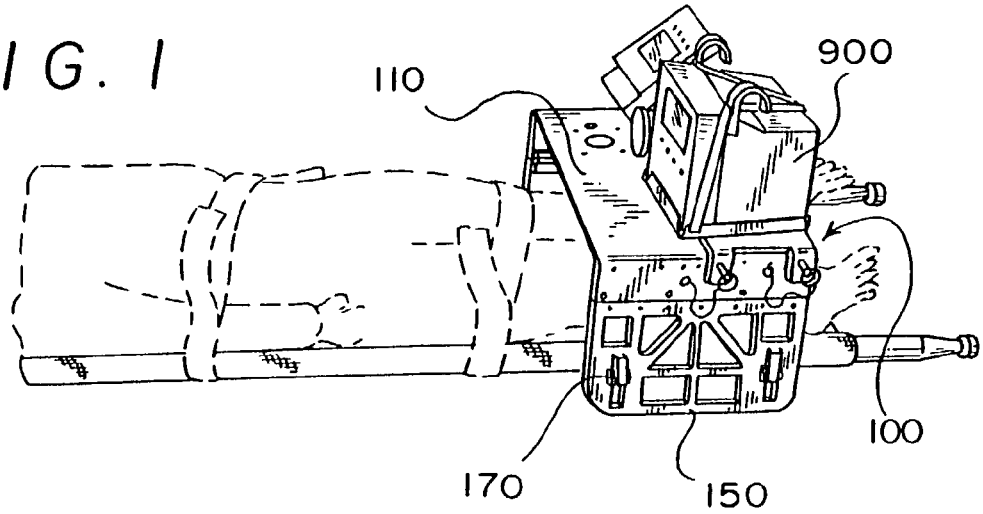
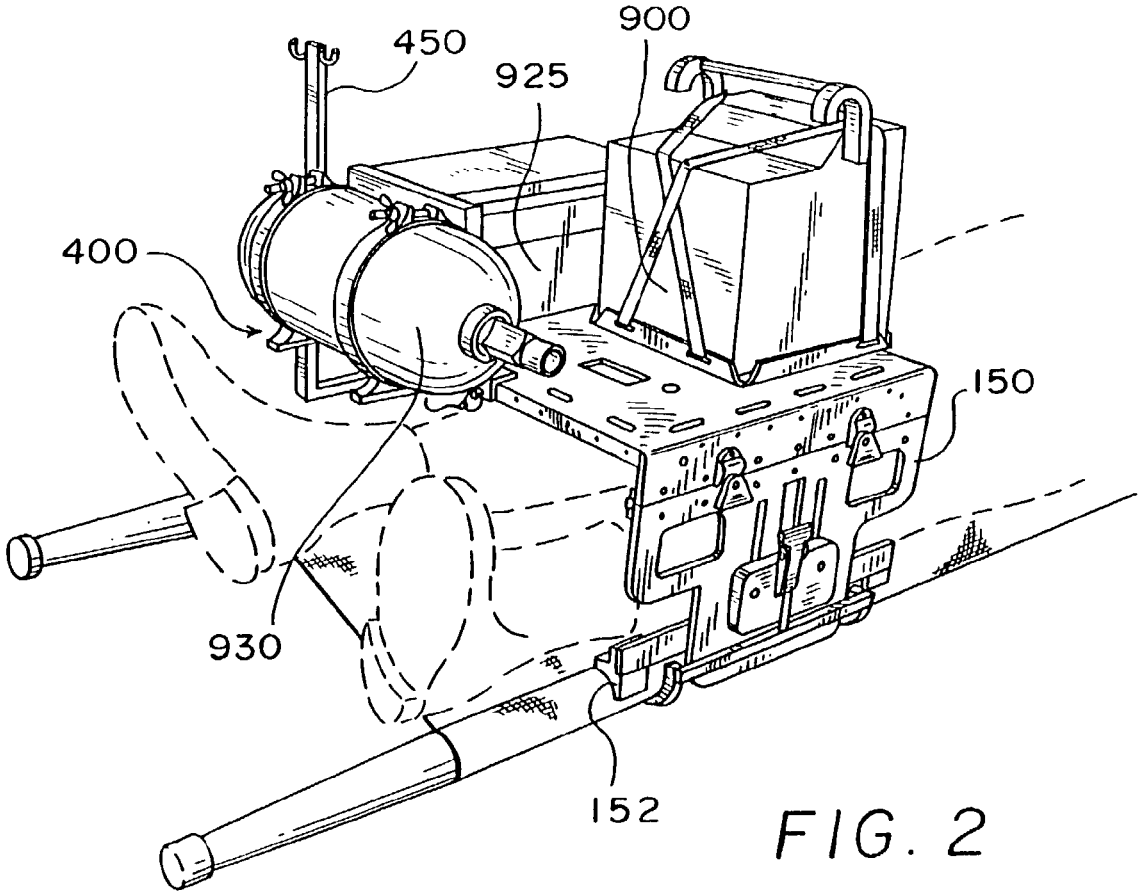
FIG. 2

FIG. 6(a)
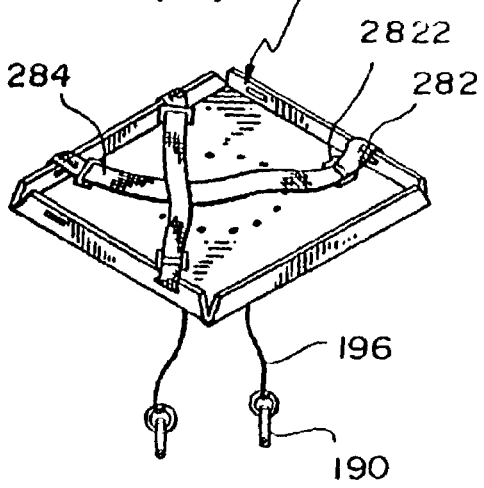
FIG. 6(c)
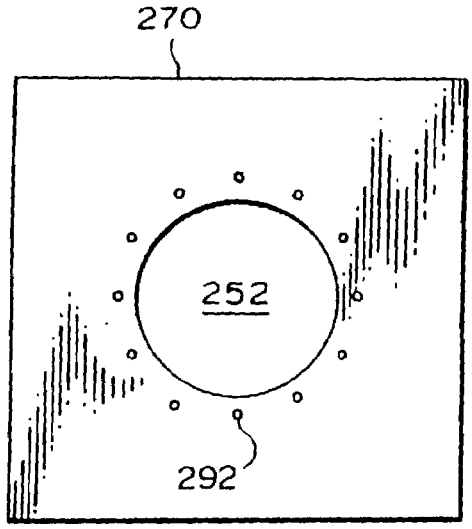
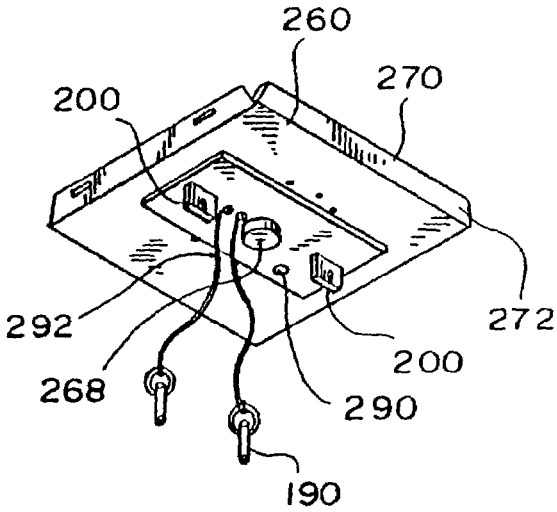
FIG. 6(b)
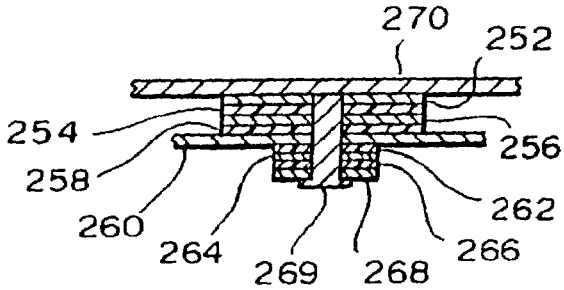
FIG. 6(d)

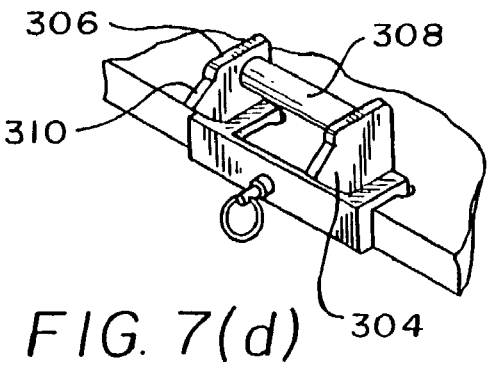
FIG. 7(d)
FIG. 7(a)
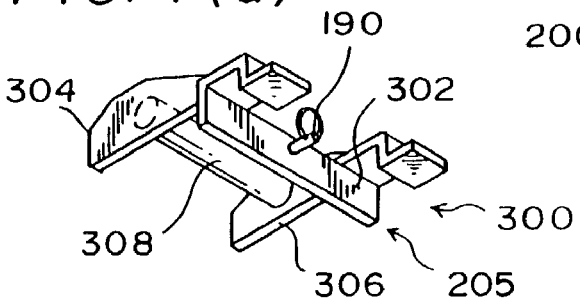
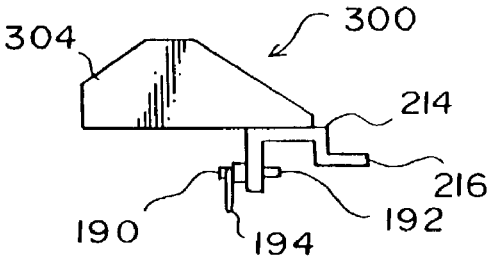
FIG. 7(b)
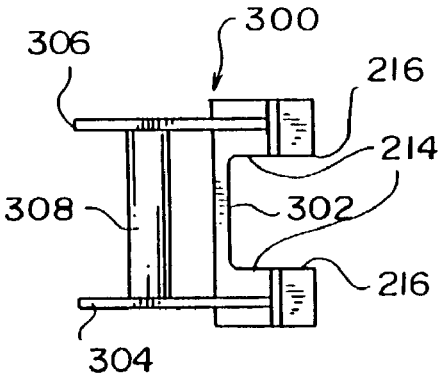
FIG. 7(c)
FIG. 8(a)
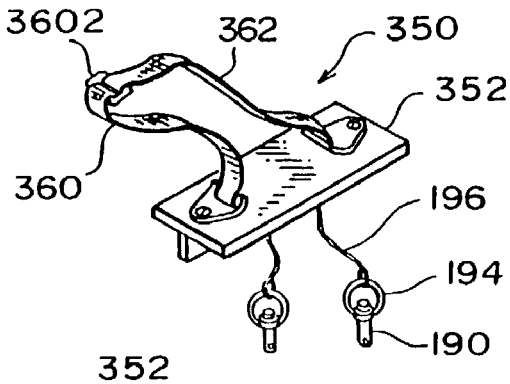
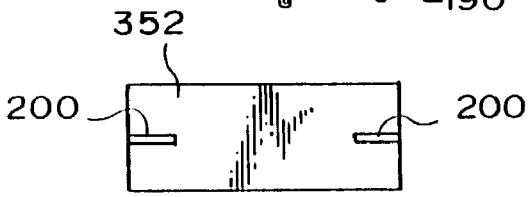
FIG. 8(b)
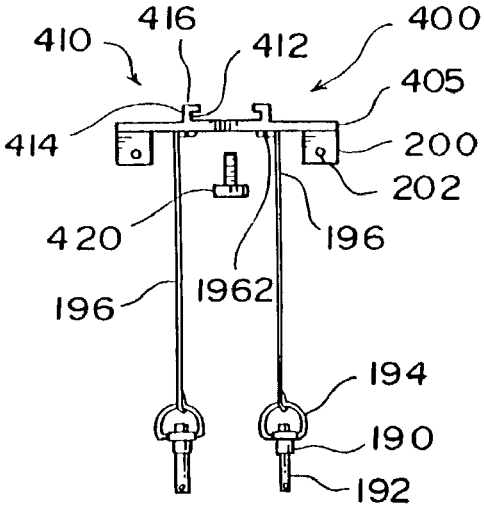
FIG. 9(a)
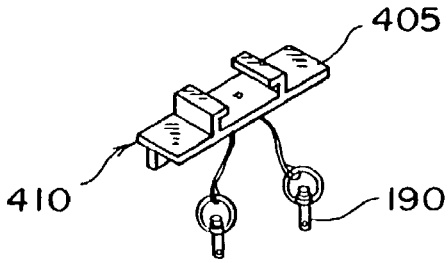
FIG. 9(b)

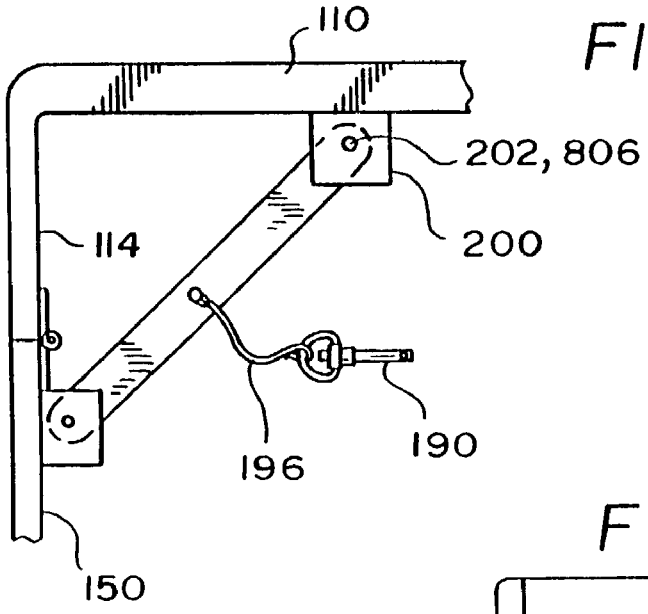
FIG. 20(a)
FIG. 20(b)
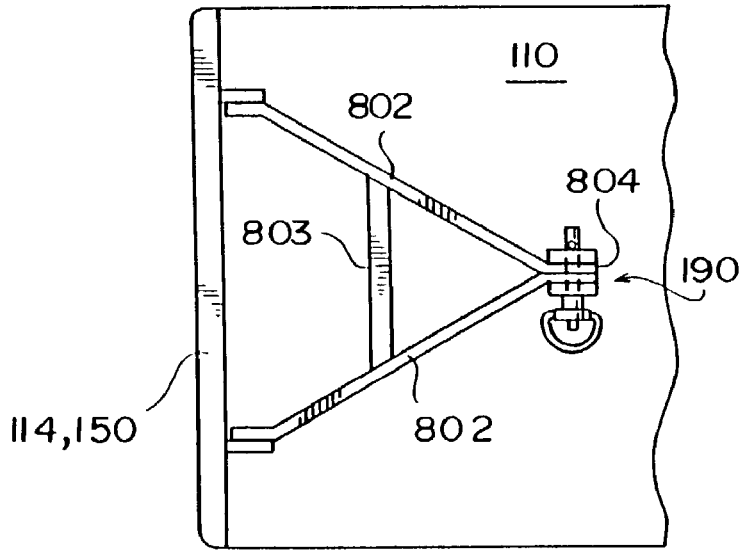
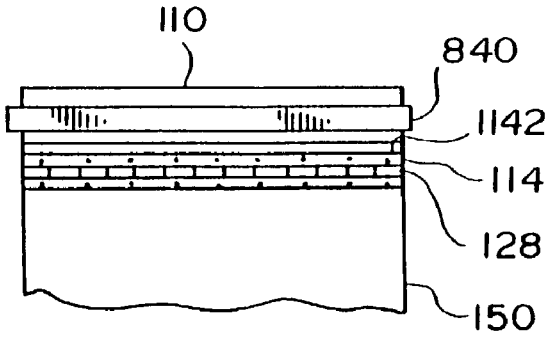
FIG. 21(a)
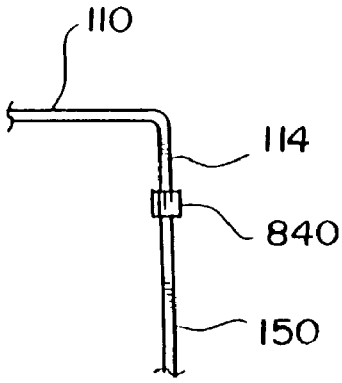
FIG. 21(b)

FIG. 24(b)
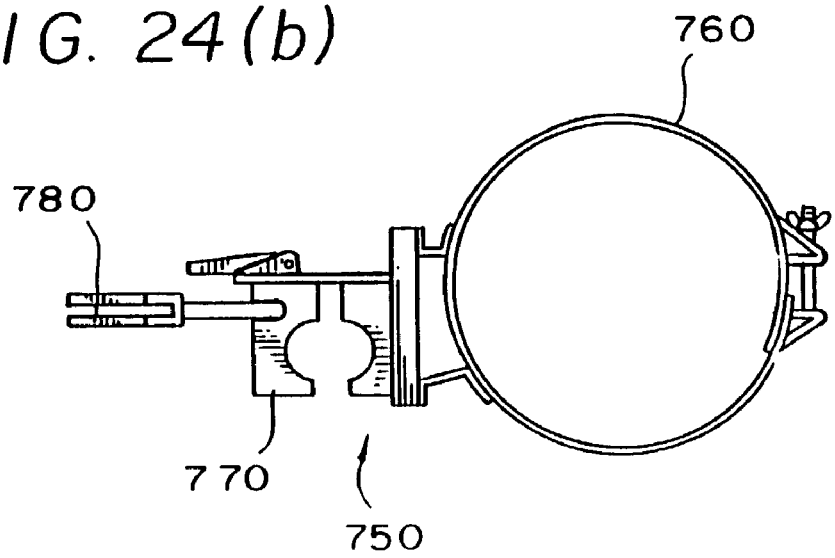
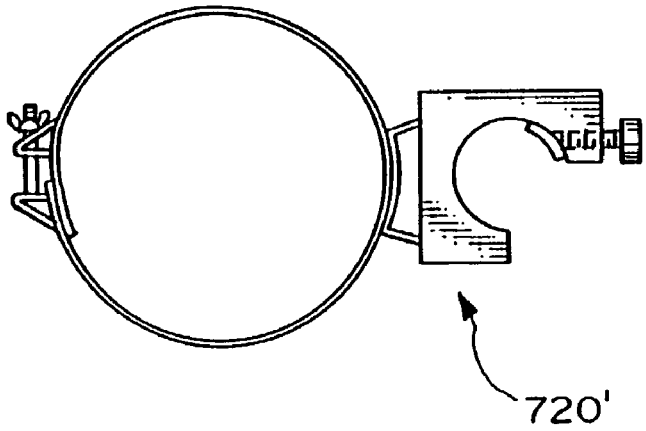
FIG. 24(c)

CRITICAL CARE PLATFORM FOR LITTERS

This application is a continuation-in-part of U.S. patent application Ser. No. 09/961,405, filed Sep. 25, 2001, which claims the benefit of U.S. provisional Application Ser. No. 60/234,760, filed Sep. 25, 2000; U.S. provisional Application Ser. No. 60/254,156, filed Dec. 11, 2000; U.S. provisional Application Ser. No. 60/282,152, filed Apr. 9, 2001; and U.S. provisional Application Ser. No. 60/291,963, filed May 21, 2001, which are all hereby incorporated by reference.

I. FIELD OF THE INVENTION

This invention relates to a structure for attaching to litters, preferably litters that meet NATO standards, and for holding medical equipment useful in the care and/or transport of patients between locations.

II. BACKGROUND OF THE INVENTION

The standard litter in use is the NATO litter or a modified version of the NATO litter. A common feature between the NATO litter and most modified versions is a two pole structure running in parallel to each other the length of an area to carry and support a patient such as nylon as illustrated in FIGS. 1 and 2. Usually, these litters are used in evacuating injured and/or wounded patients from their location of injury (or far forward facility) to a care facility for treatment.

During transport, it is vital to monitor a patient's current medical status to allow medical personnel to attempt to maintain the status quo, which preferable is sufficiently stable to allow for transport. Unfortunately, litters do not allow for the attachment of medical monitoring equipment given their structure of two poles and a place for the patient, which usually is canvas or a similar material. Instead of two individuals moving a patient, it may take at least one additional person to move along side the litter to move the equipment connected to the patient. Or the extra person may not be needed, because the equipment is put on top of the patient, which is not advisable in most medical situations given the weight of the equipment and notwithstanding the weight, the equipment may shift around on the patient and/or fall off of the patient and the litter. None of these possibilities associated with using the patient as the carrying platform are beneficial to treating the patient.

In the past few years, new devices and ways have been developed to transport the recently injured/wounded. Two examples are LSTAT, which is described in U.S. Pat. No. 5,626,151, and MIRF, which is described in U.S. Pat. No. 5,918,331. A drawback to both of these is that they have additional equipment and monitors that may not be necessary in each and every situation. The extra equipment adds weight and takes up space, in particular vertical space. In evacuation situations of multiple patients, the extra space will likely limit the number of patients that may be evacuated in any given transport vehicle due to the fact that the litter attachments will take up additional space unnecessarily.

Notwithstanding the usefulness of the above-described approaches, a need still exists for a lightweight attachment for litters that will allow particular equipment to be transported with the patient without requiring another individual to carry the equipment beyond the two individuals carrying the litter.

III. SUMMARY OF THE INVENTION

This invention preferably is a platform for use with a litter (or stretcher); more particularly, the invention is a critical care platform for use with a standard NATO litter, chemical warfare litter, or a collapsible litter.

The invention offers the maximum flexibility in securing medical equipment and/or device(s) needed for patient care directly on the patient's litter. Human performance is enhanced by strategic placement of medical equipment and/or device(s) allowing continuous patient monitoring, improved patient care access and patient comfort. The invention is an important advancement in aeromedical equipment securing technology.

According to one aspect of the present invention, an accessory clip for use with a litter stand including: a base, at least one tab depending from the base, each of the at least one tab having an opening passing therethrough, and at least one medical device interface member connected to the base.

According to one aspect of the present invention, an accessory clip for use with a litter stand including: a connector, and at least one medical device interface member attached to the connector. The connector preferably including at least one bridge, at least one tab connected to at least one of the at least one bridge, each of the at least one tab having an opening passing therethrough, and at least one tongue extending from each of the at least one bridge spaced from the at least one tab.

According to one aspect of the present invention, an accessory clip for attaching medical equipment to a litter stand, the accessory clip including: at least one accessory pin, means for connecting to the litter stand using the at least one accessory pin, and means for attaching to at least one piece of medical equipment.

According to one aspect of the present invention, an attachment system for attaching medical equipment to a litter stand, the system including a pair of straps, each of the straps includes a plurality of accessory pins, a first strap having a buckle for adjusting a length of the first strap, and a cinch ring; and a second strap for engaging the cinch ring, and wherein each first strap and second strap is attached to one of the accessory pins.

According to one aspect of the present invention, a cylinder attachment system for attaching cylinders to a litter, the system including: a first support including a bracket, a O-ring clamp mounted on the bracket, and a first swing arm pivotally connected to the bracket; and a second support including a bracket, a O-ring clamp mounted on the bracket of the second support, a second swing arm pivotally connected to the bracket of the second support; and wherein the first swing arm and the second swing arm are capable of engaging at least one of a group consisting of a litter stirrup and a litter stand, and the brackets are capable of attaching to a litter pole.

According to one form of the present invention, an apparatus for attaching to a patient carrying device and for providing an apparatus to have medical equipment in close proximity including during movement of the patient, said apparatus comprising a platform having a support surface, said support surface having a plurality of openings passing therethrough, and at least two legs, each of said legs is connected to said support surface; at least one accessory clip in communication with said support surface, said at least one accessory clip having an interface for connection with said support surface; and at least one pin for engaging said interface of said at least one accessory clip.

According to one form of the present invention, a system for attaching to a litter and carrying medical equipment needed for the care of a patient, said system comprising a platform including a support surface having a plurality of openings passing therethrough and at least two walls depending from opposing ends to each other, a hinge attached to each wall, and a leg attached to each hinge, said leg including two footings spaced from each other; at least one accessory table including an interface sized to communicate with at least one opening through said support surface, said interface having an opening passing therethrough, and means for attaching to at least one piece of medical equipment; and at least one pin, said pin sized to communicate with the opening of said interface and said support surface; and wherein said interface is held in communication with said support surface by said at least one pin.

According to one form of the present invention, a system for carrying medical equipment on a patient carrying device without interfering with the space for the patient, said system comprising at least one means for attaching to at least one piece of medical equipment, means for supporting and positioning said attaching means to the side and/or above the patient on the patient carrying device, said supporting and positioning means including means for adjusting the height of the supporting and positioning means relative to the litter.

An objective of the invention is to provide a platform mountable upon a NATO litter that allows attachment of a variety of medical equipment.

Another objective of the invention is to provide a place to mount life packs, infusion pumps, a ventilator, and/or a suction unit onto a litter.

Another objective of the invention is to provide an attachment to a litter for the placement of medical monitoring equipment and life support equipment.

Another objective of the invention is to provide a litter attachment that is reducible for storage.

Another objective of the invention is to allow for the rotation of monitoring equipment positioned upon the invention.

Another objective of the invention is to provide flexibility in the type of equipment that may be attached to the invention and where on the invention the equipment is placed. A further objective is that a change in the standard medical equipment and/or device(s) will not require that the entire invention be redesigned but instead that a new accessory clip be designed to accommodate the new piece of medical equipment and/or device(s).

Another objective of the invention is to provide a removable accessory table.

A further objective of the invention is to provide multiple positions for a pump while it is attached to the invention.

A further objective of the invention is that it is modularized for various equipment such as monitors, ventilators, intravenous pumps, oxygen bottles, or large life pack monitors.

A further objective of the invention is the ability to withstand vehicular (including aircraft) vibrations while remaining attached to a litter and maintaining the attachment of medical equipment and/or device(s). At least one embodiment of the invention preferably is designed to withstand at least 8 Gs.

A yet further objective of the invention is to provide a low profile when equipment is attached as compared to a patient laying on a litter without the invention being attached.

A yet further objective of the invention is that when mounted on a litter, the litter may still be stacked within a vehicle.

A yet further objective of the invention is to have a lightweight platform.

A still further objective of the invention is the quickness at which it may be attached to or removed from a litter.

A still further objective of the invention is that it be noncorrosive and not susceptible to rust.

An advantage of the invention is the firmness of the attachment between it and a litter.

Another advantage of the invention is the stability achieved for the medical equipment and/or device(s) present on it.

Another advantage of the invention is the flexibility offered in the medical equipment and/or device(s) that may be attached to it.

Another advantage of the invention is that when tilted the attached medical equipment and/or device(s) will not fall off.

Another advantage of the invention is that there are at least two different mounting positions for an infusion pump each of which offer different visual angles.

Another advantage of the invention is that a medical monitor may be rotated between multiple positions to improve viewing by the medical personnel providing care for and/or transporting the patient.

A further advantage of the invention is that when mounted on a lifter it will not interfere with the placement of the litter on stands or carts.

A further advantage of the invention is that it accomplishes the above-identified objectives.

A yet further advantage of the invention is that it provides for flexibility in the medical equipment and/or device(s) that may be attached offering modularity in the types of attachment.

A yet further advantage of the invention is that at least one embodiment is approved for use during all phases of flight on all U.S. Air Force aircraft (including fixed and rotary wing).

A still further advantage of the invention is that in at least one embodiment allows for height adjustment relative to the litter.

Given the following enabling description of the drawings, the invention should become evident to a person of ordinary skill in the art.

IV. BRIEF DESCRIPTION OF THE DRAWINGS

The present invention is described with reference to the accompanying drawings. In the drawings, like reference numbers indicate identical or functionally similar elements. The use of cross-hatching and shading within the drawings is not intended as limiting the type of materials that may be used to manufacture the invention.

FIG. 1 illustrates an embodiment according to the invention attached to a litter with medical equipment attached to the invention.

FIG. 2 depicts another embodiment according to the invention attached to the litter with medical equipment attached to the invention.

FIGS. 6(*a*)-(*d*) depict a variety of views of an exemplary monitor accessory clip according to the invention. FIG. 6(*a*) illustrates a perspective top view of the accessory clip. FIG. 6(*b*) depicts a bottom view of the entire accessory clip. FIG. 6(*c*) illustrates a bottom view of the monitor platform portion of the accessory clip. FIG. 6(*d*) depicts a cross-section of the center portion of the accessory clip.

FIGS. 7(*a*)-(*c*) depict an exemplary infusion pump accessory clip according to the invention. FIG. 7(*a*) provides a perspective view from the bottom. FIG. 7(*b*) is a side view. FIG. 7(*c*) is a top view. FIG. 7(*d*) depicts an alternative embodiment for a portion of the accessory clip shown in FIGS. 7(*a*)-(*c*).

FIGS. 8(*a*)-(*b*) illustrate an exemplary ventilator accessory clip according to the invention. FIG. 8(*a*) depicts a top perspective view. FIG. 8(*b*) illustrates a bottom view of the accessory clip.

FIGS. 9(*a*)-(*b*) depict another exemplary ventilator accessory clip according to the invention. FIG. 9(*a*) is a side view. FIG. 9(*b*) is a top view.

Figure 10A:
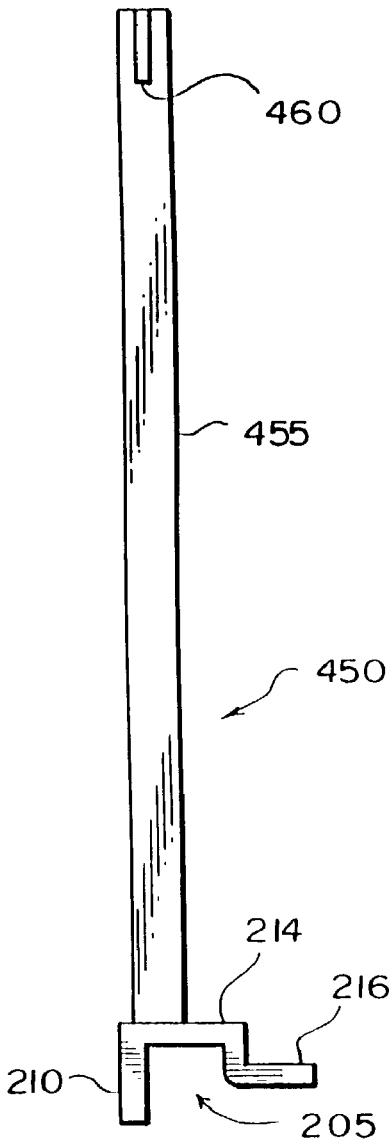
Figure 10B:
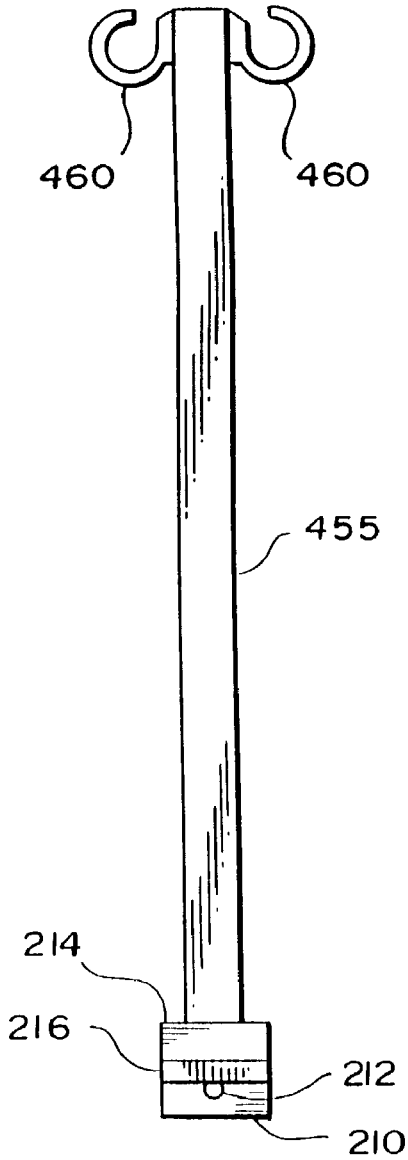

FIGS. 10(*a*)-(*b*) illustrate an exemplary IV bag accessory clip according to the invention. Both figures offer different side views.

Figure 11:
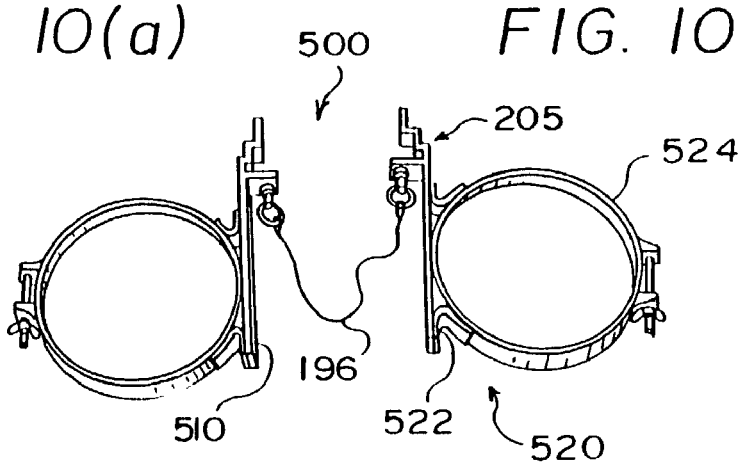

FIG. 11 depicts an exemplary cylinder object accessory clip according to the invention.

Figure 12A:
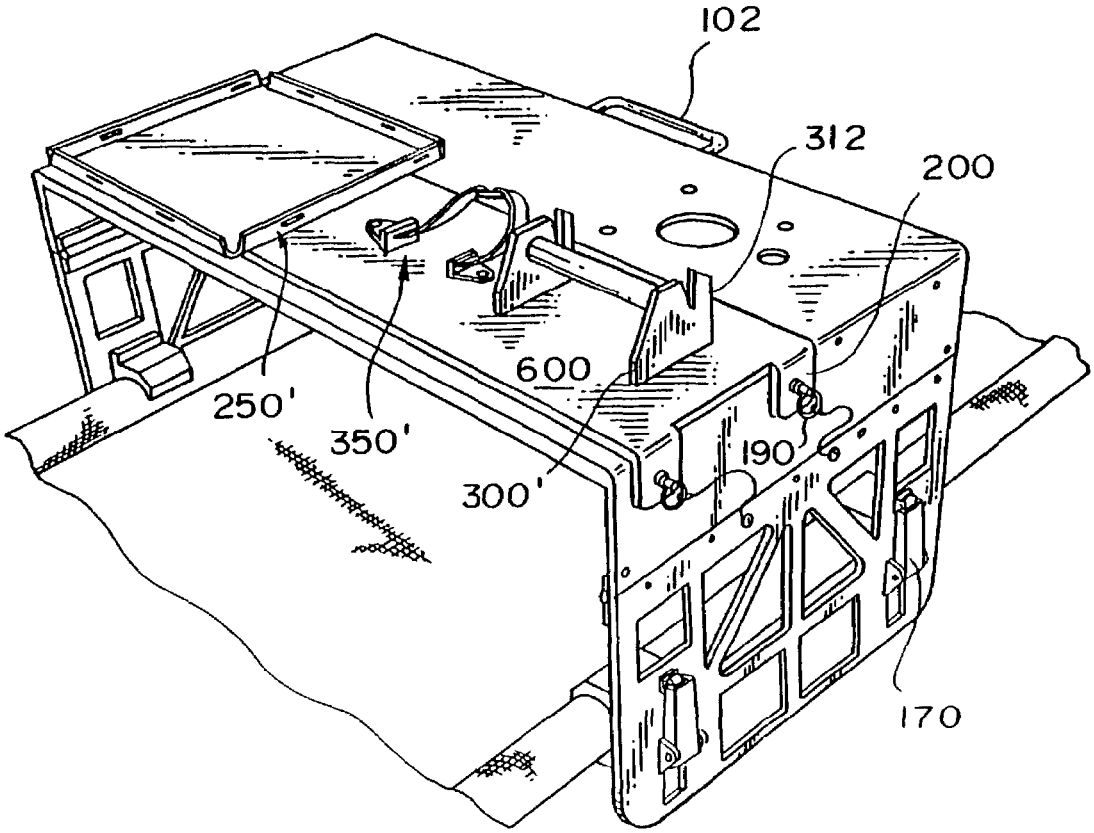
Figure 12B:
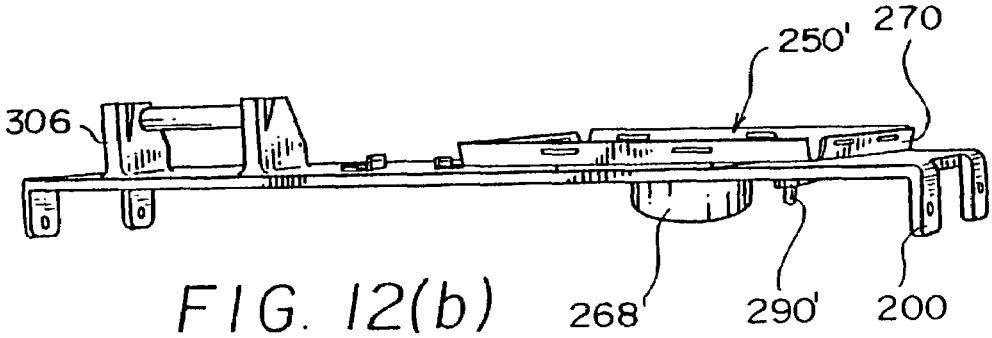

FIGS. 12(*a*)-(*b*) illustrate an exemplary multiple attachment accessory clip according to the invention. FIG. 12(*a*) illustrates the accessory clip attached to a platform according to the invention. FIG. 12(*b*) illustrates a side view of the accessory clip by itself.

Figure 13:
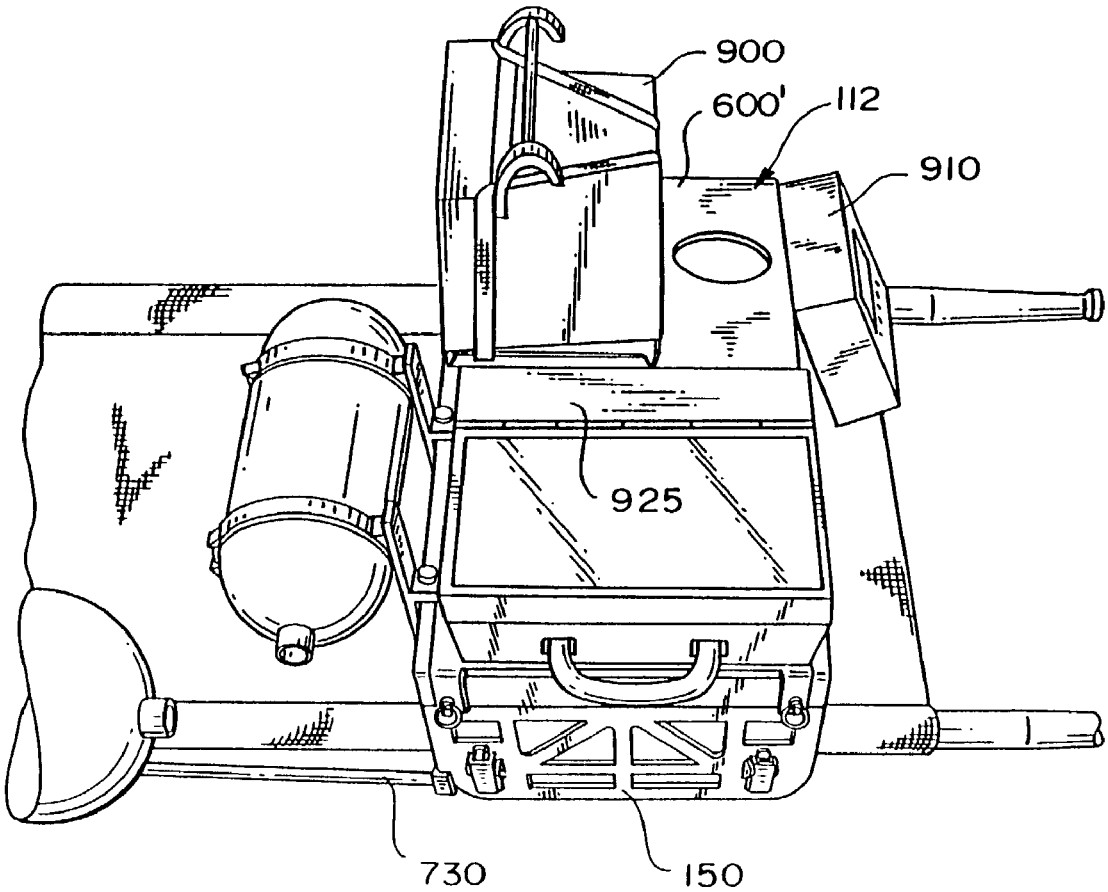

FIG. 13 depicts another exemplary multiple attachment accessory clip according to the invention attached to a litter.

Figure 14:
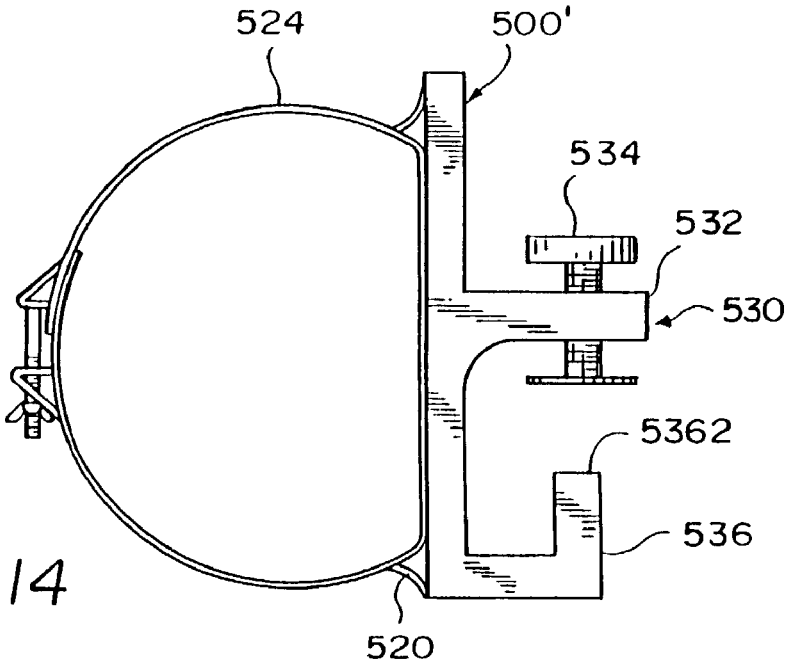

FIG. 14 illustrates a side view of an alternative cylinder object accessory clip according to the invention.

Figure 15:
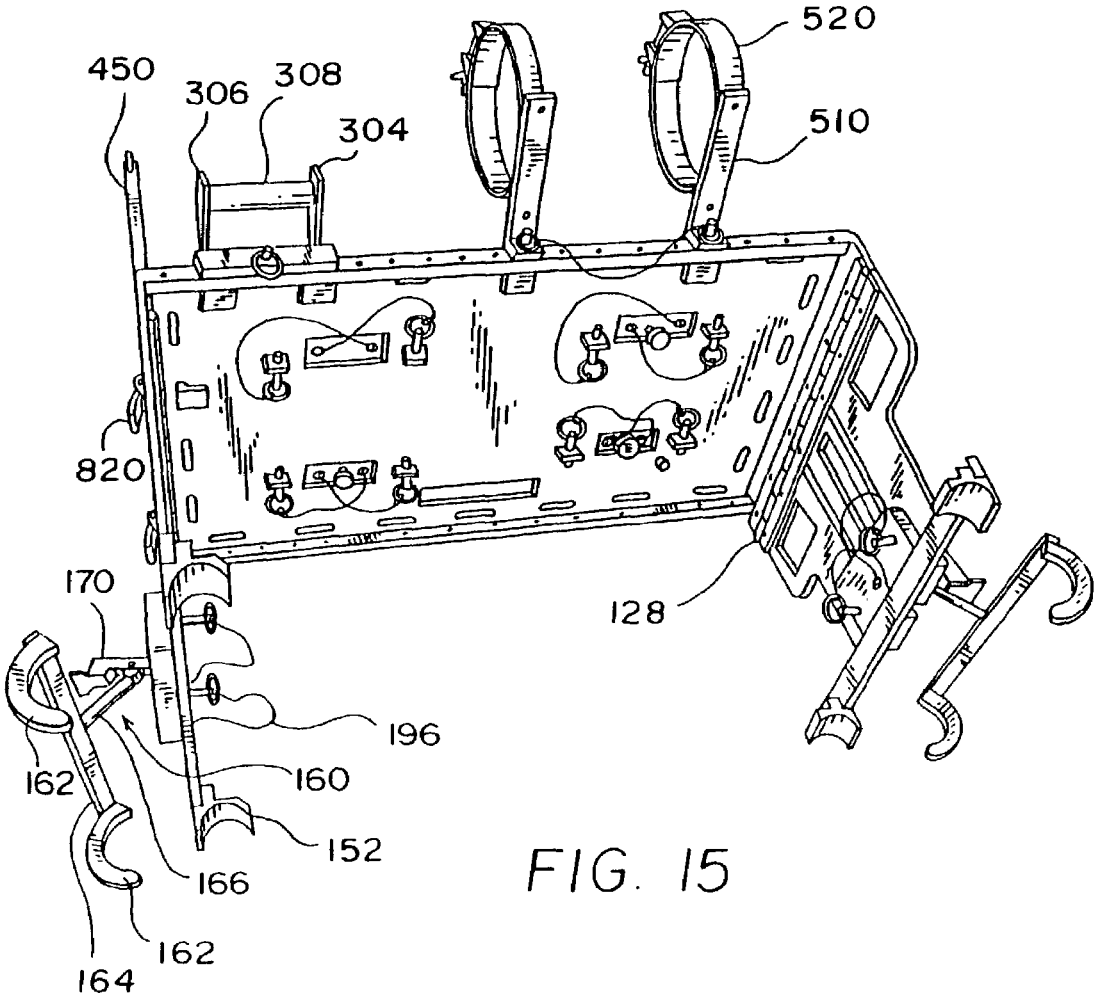

FIG. 15 depicts a bottom perspective view of an embodiment according to the invention.

Figure 16A:
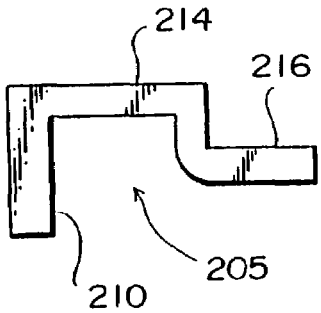
Figure 16B:
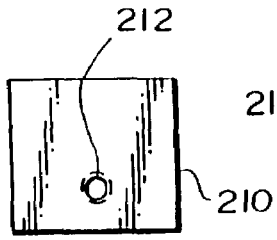
Figure 16C:
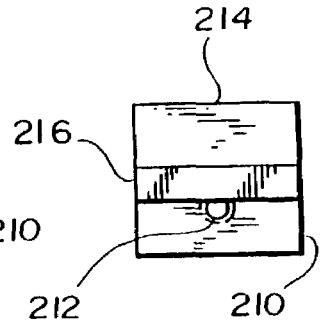

FIGS. 16(*a*)-(*c*) illustrate different views of the connector according to the invention.

Figure 17A:
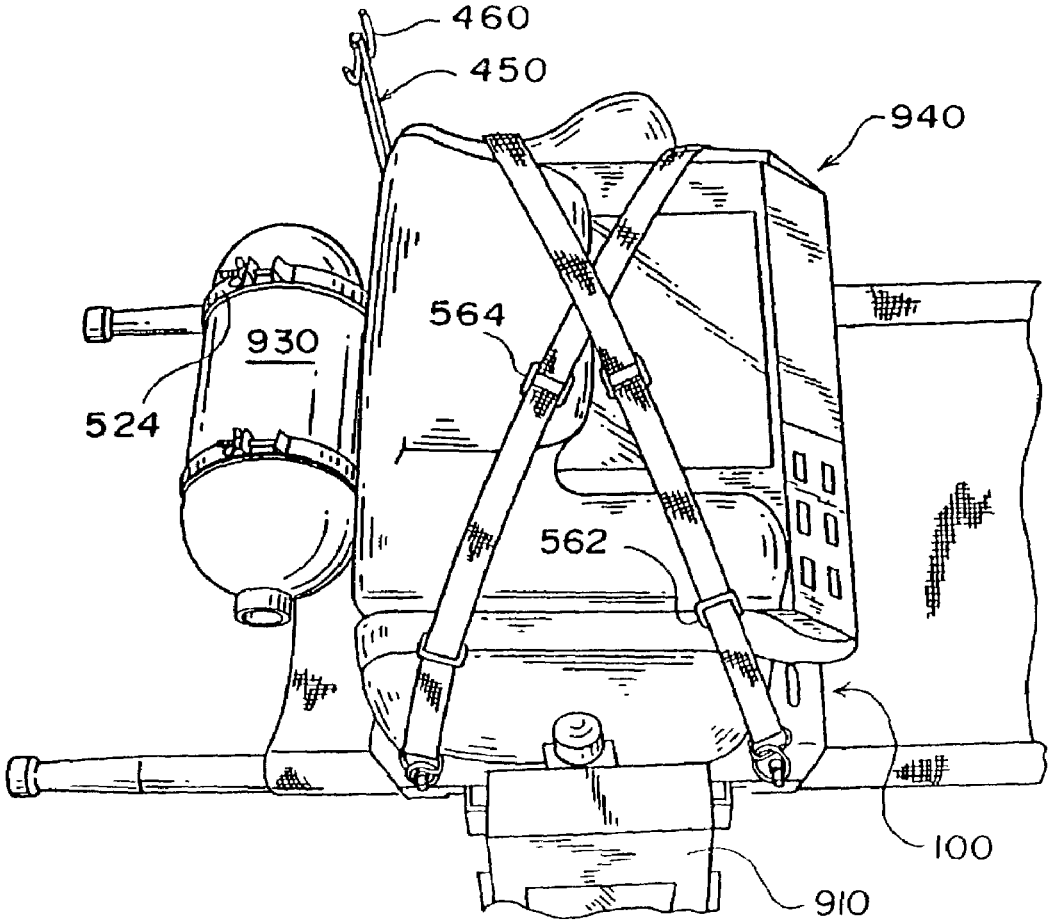
Figure 17B:
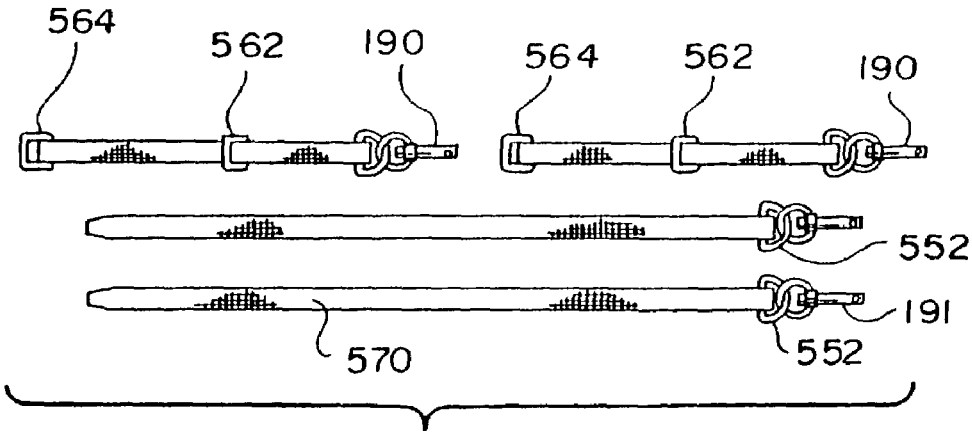

FIGS. 17(*a*)-(*b*) depict another accessory clip according to the invention.

Figure 18A:
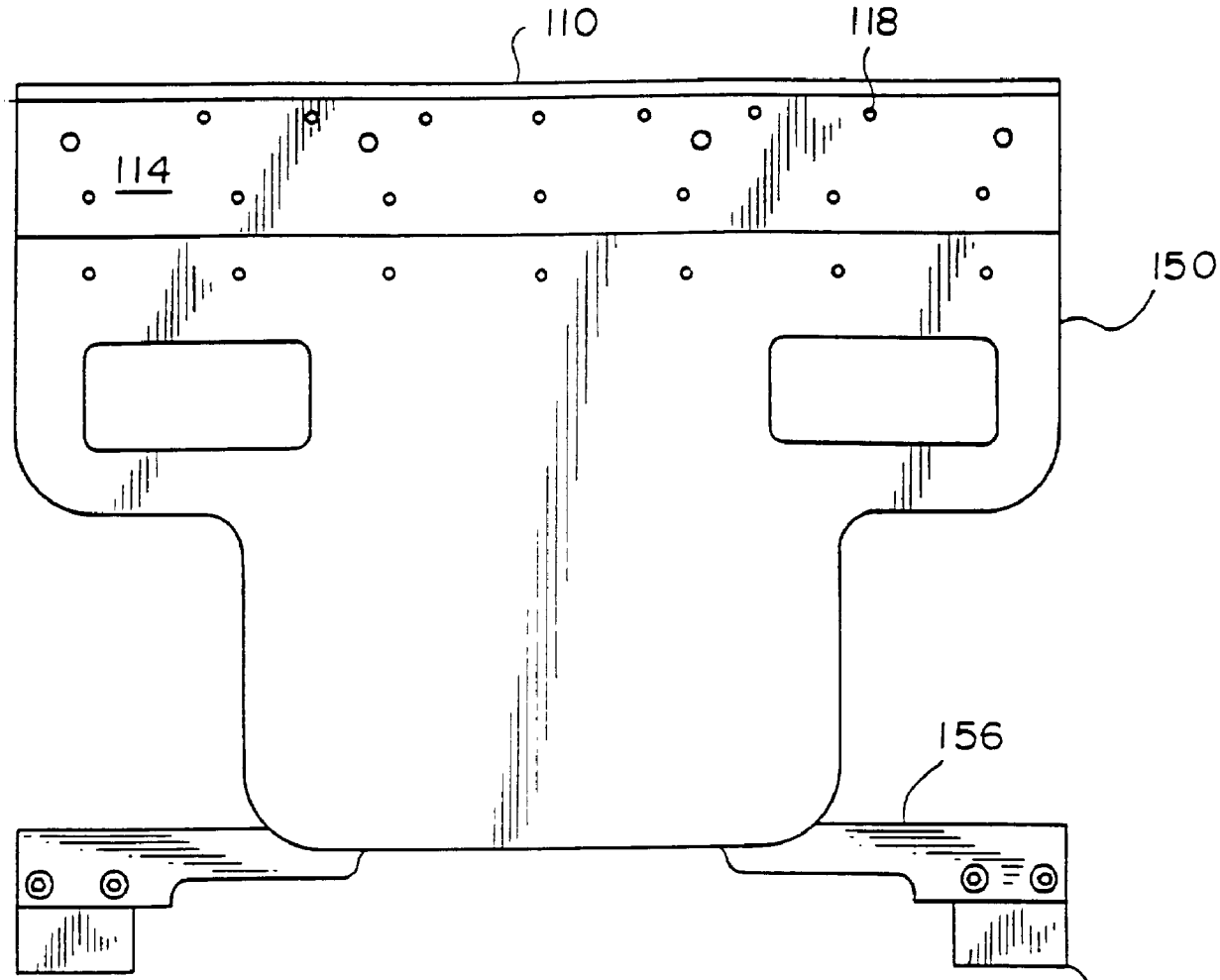
Figure 18B:
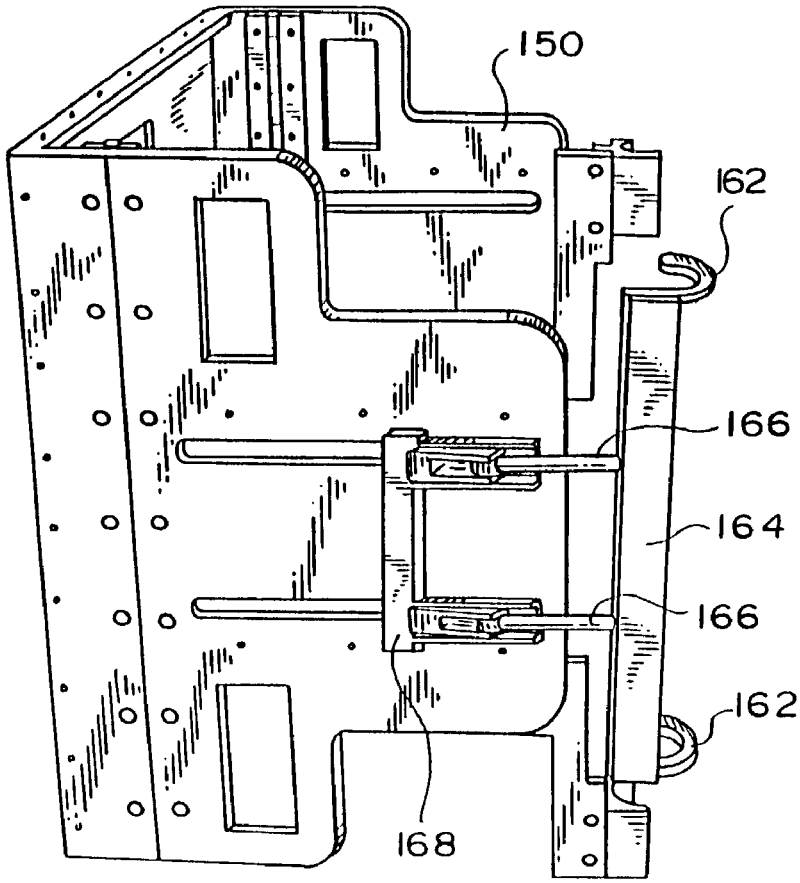

FIGS. 18(*a*)-(*b*) illustrate a view of the leg portion of an embodiment according to the invention. FIG. 18(*a*) illustrates the leg without a securing mechanism according to the invention.

Figure 19:
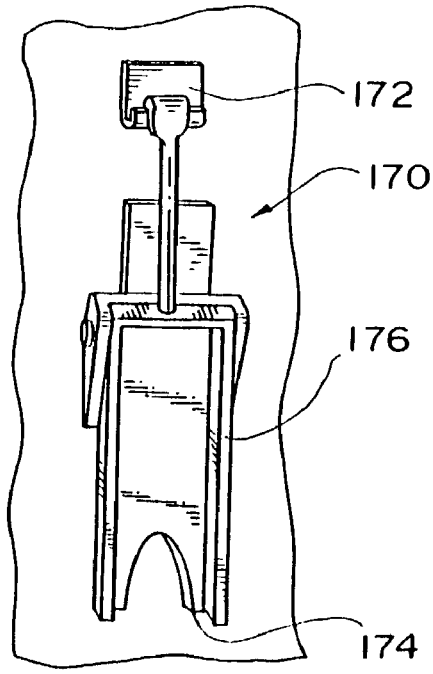

FIG. 19 depicts a locking mechanism according to the invention.

FIGS. 20(*a*)-(*b*) illustrate a brace according to the invention. The break lines indicate the incomplete nature of the platform illustrated in these Figures.

FIGS. 21 (*a*)-(*b*) depict a sleeve according to the invention. The break lines indicate the incomplete nature of the platform illustrated in these Figures.

Figure 22A:
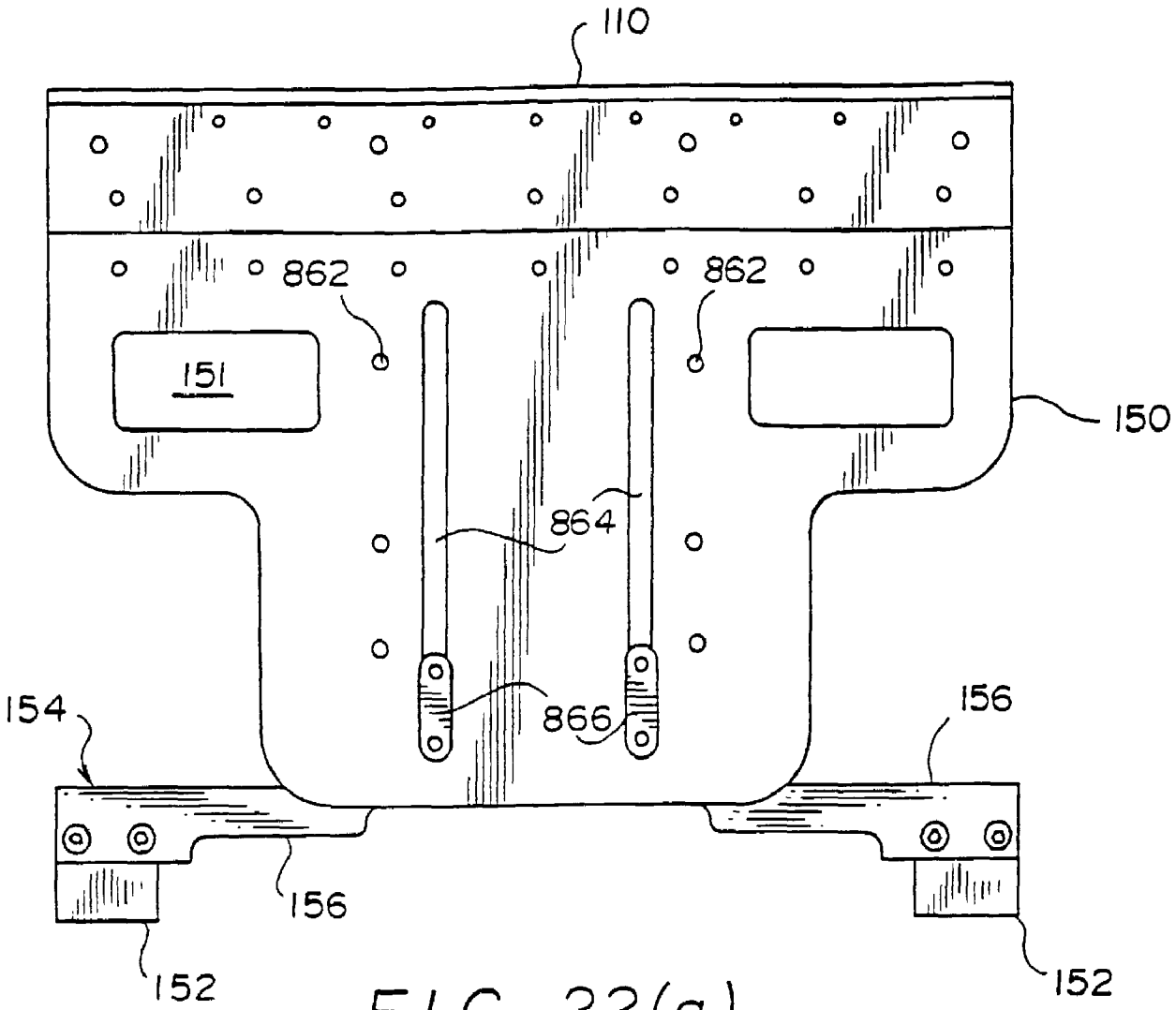
Figure 22B:
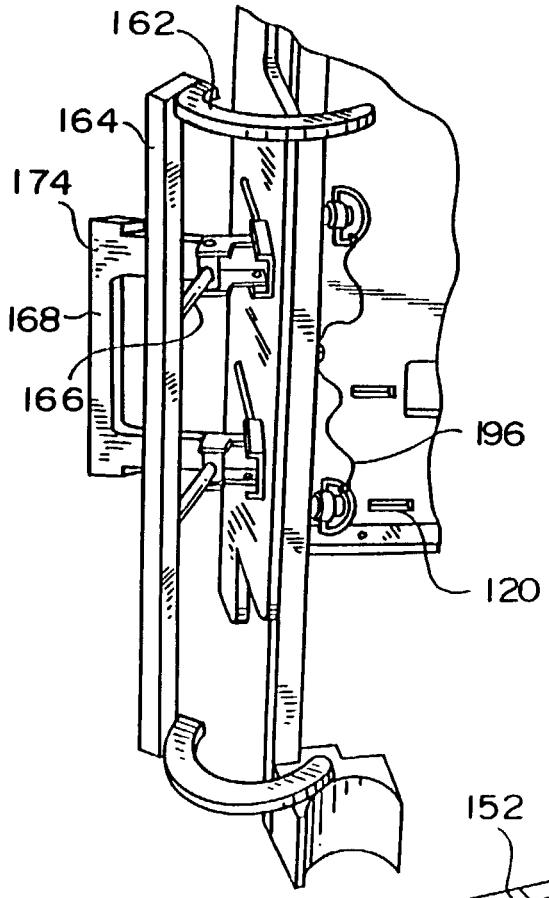
Figure 22C:
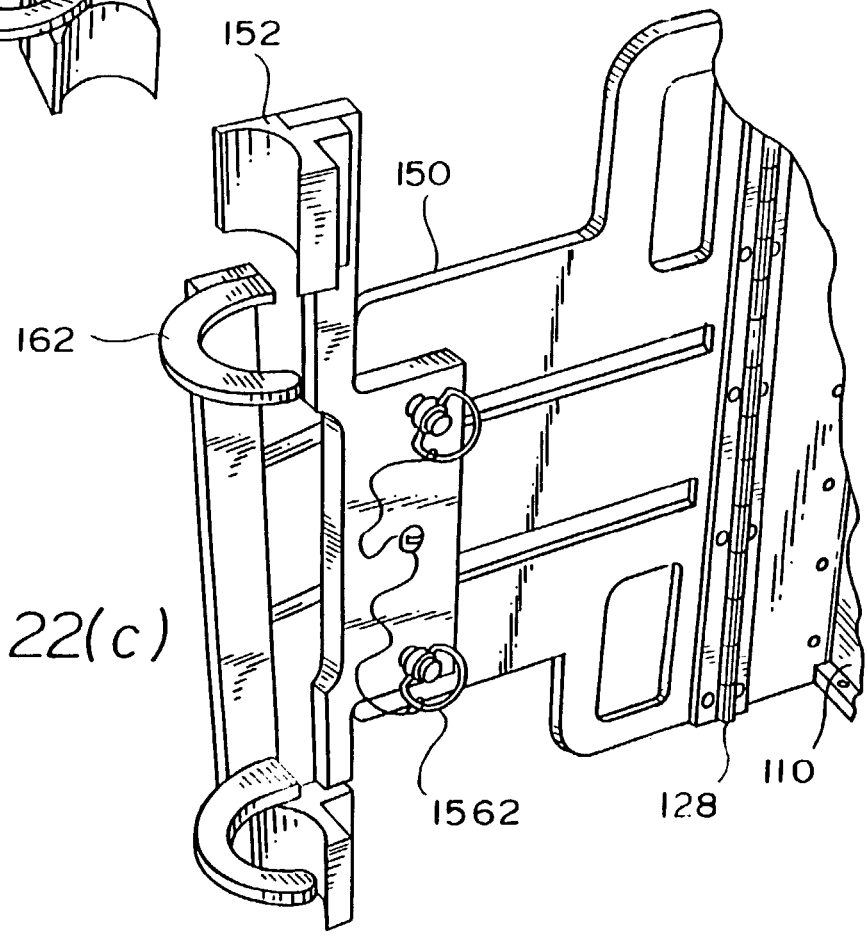

FIGS. 22(*a*)-(*c*) illustrate a height adjustment alternative embodiment according to the invention.

Figure 23A:
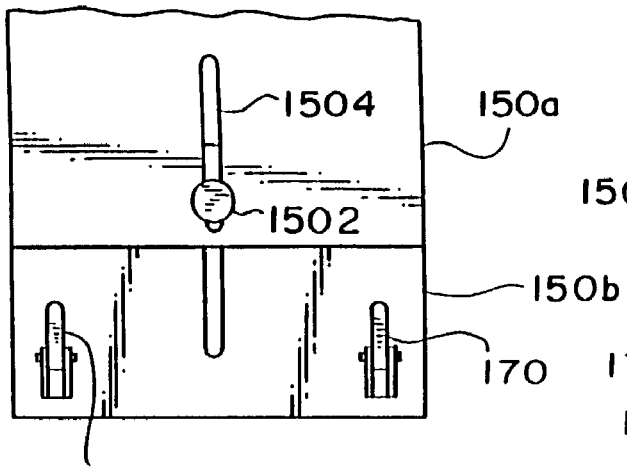
Figure 23B:
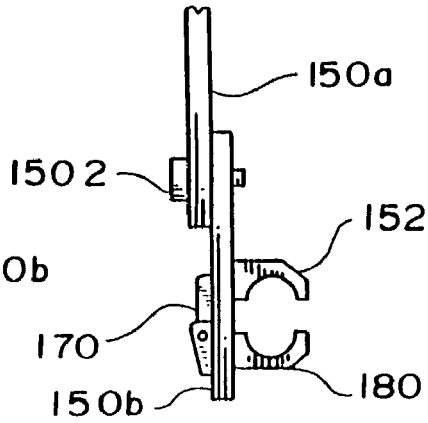
Figure 23B:
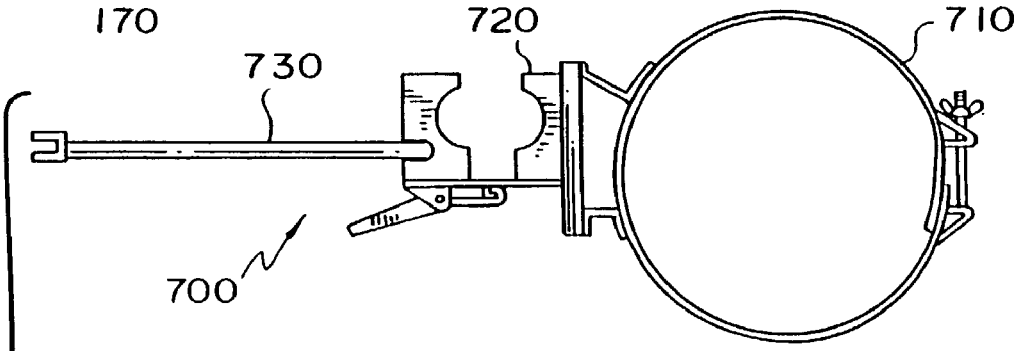

FIGS. 23(*a*)-(*b*) depict another height adjustment alternative embodiment according to the invention.

Figure 24A:
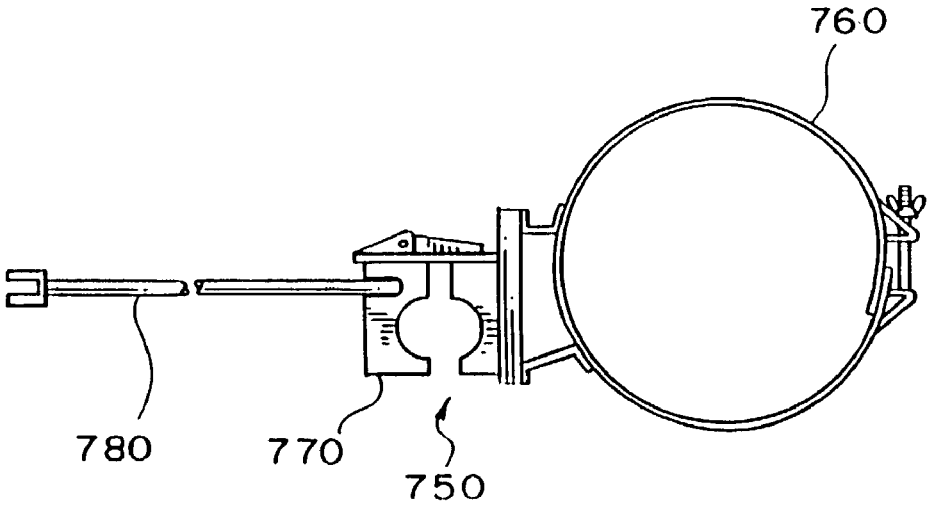

FIGS. 24(*a*)-(*b*) depict a cylinder attachment to a litter according to the invention.

FIG. 24(*c*) illustrates another cylinder attachment to a litter according to the invention.

V. DETAILED DESCRIPTION OF THE DRAWINGS

The invention preferably is for holding medical equipment and/or device(s) that is required for assisting in the care of a patient on a litter. The patient may be human or animal that is able to be carried upon a litter such as a litter conforming to NATO standards, chemical warfare litter, a collapsible litter or other patient carrying mechanism. More particularly, the invention preferably includes a platform and at least one accessory clip. As illustrated, for example, in FIGS. 1 and 2, the platform 100 preferably attaches to the litter or other patient carrying mechanism, while also preferably being able to stand on its own when not attached to a litter or other patient carrying mechanism. The platform 100 and its different embodiments are a means for supporting and positioning said attaching means to the side and/or above the patient on the patient carrying device. Preferably, the at least one accessory clip (or apparatus clip) allows for at least one piece of medical equipment, device(s), and/or container(s) such as monitors (250), pumps (300), ventilators (350, 400), suction units, IV bags (450), oxygen bottles (500) to be attached to the platform as illustrated, for example, in FIG. 2.

The platform 100 preferably includes a support surface 110 and at least two legs 150, 150. More preferably, there are two legs with one leg 150 at each end of the support surface 110 as illustrated, for example, in FIGS. 1-4. Although the legs 150, 150 are shown at the ends of the support surface 110, the legs 150,150 may be spaced independently or separately from the ends of the support surface 110. The support surface 110 preferably extends across the width of the litter and its length across the litter is preferably greater than its depth along the length of the litter as illustrated, for example, in FIGS. 1 and 2. The support surface 110 preferably includes multiple connection points along at least one of the top 112 or sides 114, 116 for connecting the accessory clip(s) to the support surface 110 as illustrated, for example, in FIGS. 4 and 5.

The accessory clip preferably attaches to the platform 100 such that it will not become unintentionally separated from the platform 100. The accessory clip preferably includes an attachment for medical equipment, device(s), and/or container(s) as illustrated, for example, in FIGS. 6(*a*)-15. The accessory clip also preferably includes an interface for attaching to the platform (or means for connecting to the litter stand 100 using at least one accessory pin 190), and more preferably for engaging at least one of the multiple connection points of the support surface.

Preferably, the connection between the accessory clip and the platform is solidified by at least one accessory pin 190 as illustrated, for example, in FIGS. 1, 12(*a*), and 15. The accessory pin 190 may for example be a quick-release pin such as a positive-locking pin or a hand-retractable spring plunger. More particularly, the accessory pin 190 could be a ring-grip style, recessed-button style, T-handle style, L-handle style, or button-handle style. Each accessory pin 190 preferably includes a bearing at an insertion end 192 to hold the accessory pin 190 in place once inserted through a hole in the interface. Each accessory pin 190 preferably also includes a pull mechanism 194 such as a ring at the other end of the accessory pin 190. Preferably, the accessory pins 190 will release upon the application of a pulling force along the radial center or parallel to the radial center of the accessory pin 190. Preferably, the interface and the accessory pins 190 work in conjunction with each other to connect the accessory clip to the support surface 110 of the platform 100.

Figure 3:
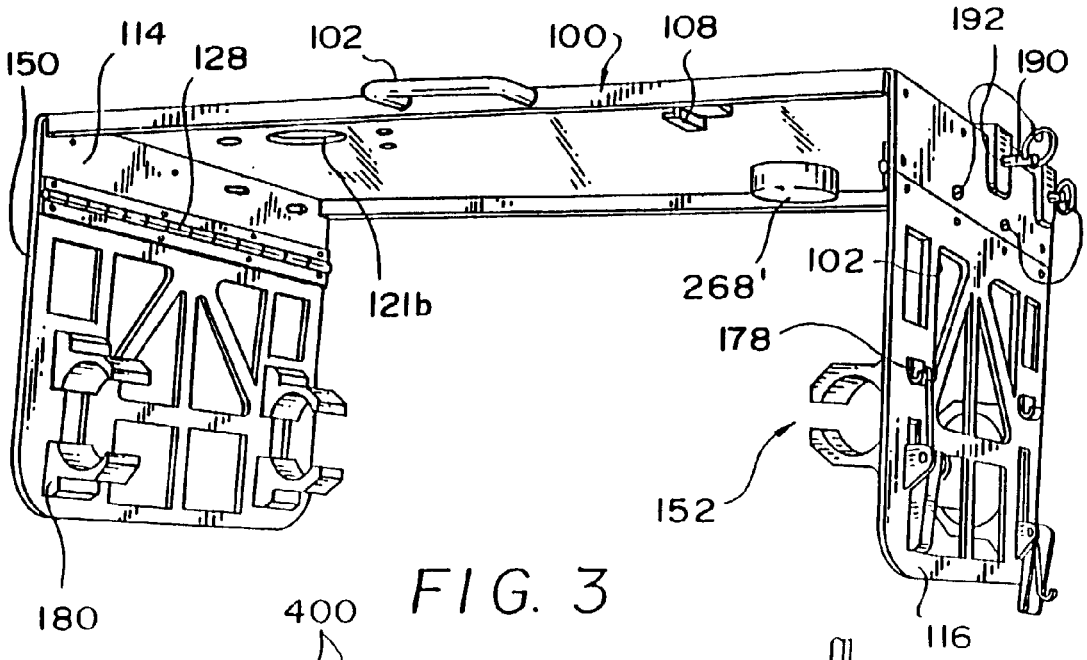
FIG. 3 illustrates the embodiment shown in FIG. 1 unattached to a litter.
Figure 4:
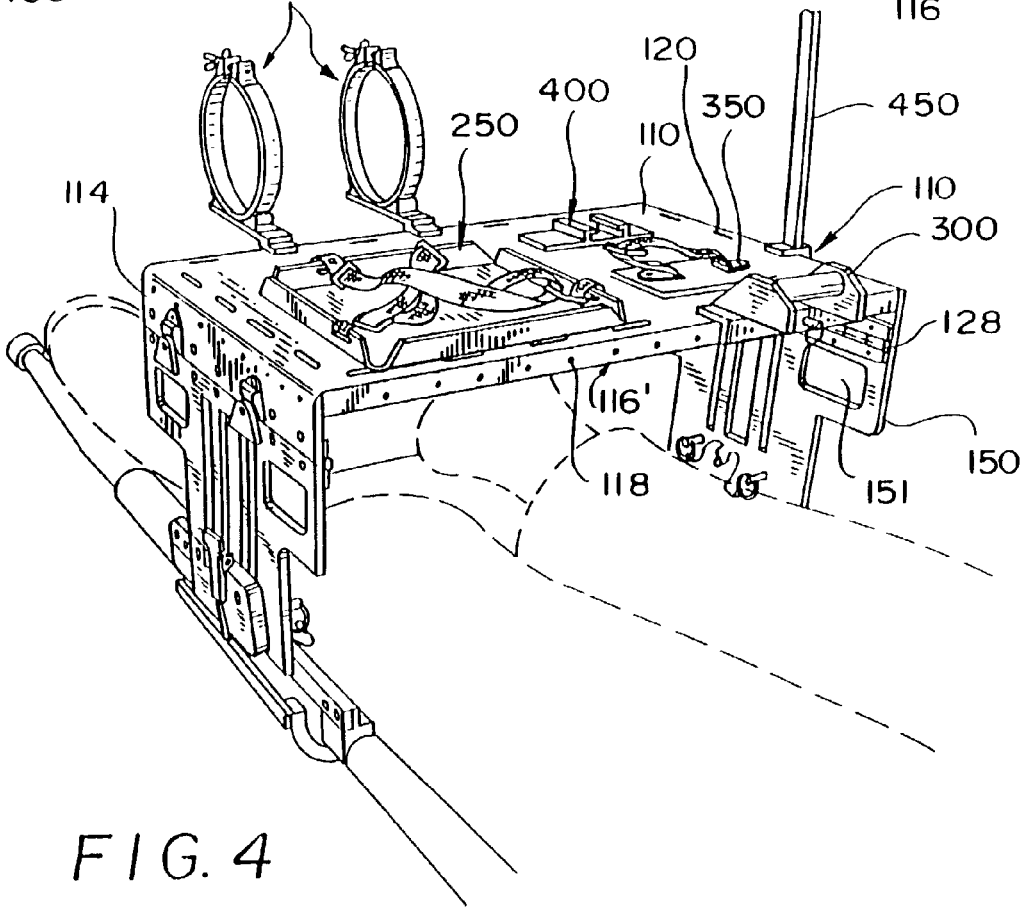
FIG. 4 depicts the embodiment shown in FIG. 2 with a variety of accessory clips attached to the platform according to the invention.
Figure 5:
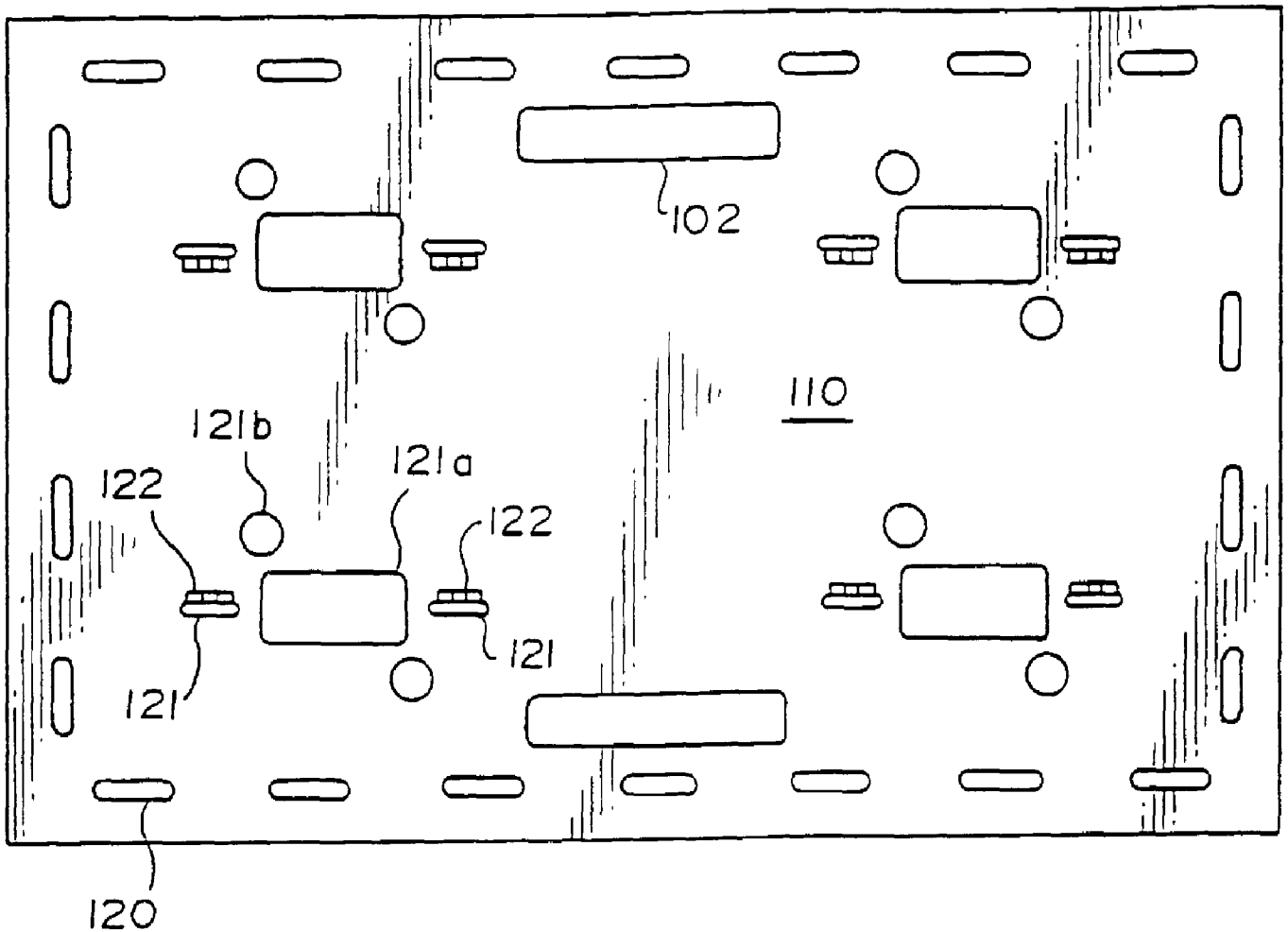
FIG. 5 illustrates a top view of a platform according to the invention.

More particularly as illustrated, for example, in FIGS. 3, 4, and 15, the support surface 110 of the platform 100 preferably is attached to each of the legs 150 with a respective continuous hinge 128 preferably using, for example, screws, rivets, harden cores such as made from steel, bolts, welding, adhesives, bonding or other similar type connection devices. However, other equivalent devices could be used to attach the legs 150, 150 to the support surface 110. These various attachment methods may be used when connection or attachment between two pieces/elements is needed in connection with this invention. The support surface 110 preferably includes a top 112 and a vertical wall 114 extending down from the top on at least the two ends where the legs 150 are attached. More preferably, the support surface 110 also has a vertical wall 116 depending from the other two sides such that vertical walls 114, 116 frame the underside of the support surface 110. More preferably, the vertical walls 114, 116 include a series of holes 118 for engaging accessory pins 190 as illustrated, for example, in FIG. 4. Alternatively, the series of holes 118 may be of varying sizes to accommodate different sized accessory pins. Walls 114, 116 although shown as being on the edge of the support surface 110, the walls 114, 116 may be spaced independently or separately from the edges of the support surface 110.

Preferably, the top surface 112 of the support surface 110 includes multiple slots and/or holes 120, 121 as illustrated, for example, in FIG. 4. More preferably, for at least some of the holes 118 in a vertical wall 114, 116 there is a corresponding slot 120 parallel to the side wall 114, 116. Also more preferably, for each of the remaining slots 121 through the support surface 110 there is a respective tab 122 on the bottom of the support surface 110 with a hole 124 passing through it and a paired slot as illustrated, for example, in FIG. 5. Alternatively, there may be a rectangular hole(s) 121*a* and/or circular hole(s) 121*b* that corresponding to the pairs of slots 121, 121 for particular accessory clips. Alternatively, the vertical walls 116 running the length of the platform 100 may be attached bars such as a reinforcing bar 116' as illustrated, for example, in FIG. 4 instead of being unitarily formed with the support surface 110.

The accessory clips preferably include one of two interfaces. The first interface preferably is a pair of tabs 200 each of which has a hole 202 passing therethrough as illustrated, for example, in FIG. 9(*a*). The tabs 200 preferably are inserted through the slots 121 along the top of the support surface 110. In most embodiments using the pair of tabs 200, the tabs 200 will depend from a base or bridge 204. The second interface preferably is a connector 205 that includes a tab 210, a bridge 214, and a tongue 216 as illustrated, for example, in FIGS. 16(*a*)-(*c*). The tab 210 preferably is vertical and connected to the bridge 214, which preferably is horizontal. The tab 210 preferably includes a hole 212 passing therethrough. The tongue 216 preferably extends from the bottom of the other end (opposite the tab 210) of the bridge 214 such that it can be inserted into a slot 120 along the top of the support surface 110 while aligning the hole 212 in the tab 210 with a hole 118 on the side wall 114, 116 of the support surface 110. The aligned holes 118, 212 preferably allow an accessory pin 190 to be inserted through both holes 118, 212. More preferably, the bottom end of the tongue 216 nearest the bridge 214 is chamfered as illustrated, for example, in FIG. 16(*a*). Alternatively, the top portion of the intersection of the tongue 216 and bridge 214 may also be chamfered. Alternatively, the tab 210 may connect a pair of bridges 214, 214 and tongues 216, 216 with the hole 212 passing through a central point on the tab 210' as illustrated, for example, in FIG. 7(*a*).

Different accessory clips preferably are able to attach to medical equipment and/or device(s) such as monitors, ventilators, pumps, suction units, other lightweight equipment, or medical containers such as oxygen bottles, IV bags, and blood bags. Depending upon what is to be attached to the invention, the accessory clip will be the way to attach a particular device. As such the invention provides flexibility to allow the addition of new accessory clips to fit new medical equipment and/or device(s) that may be developed in the future or be adopted for use without requiring that the entire litter stand be redesigned, rebuilt, or retrofitted to work with the new medical equipment and/or device(s). Examples of different possibilities for the accessory clip are described below and each of the described ways to accomplish the attachment to an external object is a medical device interface member and/or a means for attaching to at least one piece of medical equipment, which includes medical devices and/or medical containers as those terms are commonly understood and have been explicitly defined in this specification.

FIGS. 6(*a*)-(*d*) illustrate one possible accessory clip 250, which provides an attachment for a medical monitor 900. This accessory clip 250 preferably allows for rotation and setting of the medical monitor 900 to different angles on the platform 100 to optimize the viewing for the medical personnel who are treating, caring for or transporting the patient. This accessory clip 250 preferably includes a monitor platform 270, a disc 252 attached to the monitor platform 270, a bearing 256, a base 260 with a two tab interface 200, 200, a second bearing 264, and a hub 268. Preferably, there is a screw or bolt 269 that connects the hub 266 to the disc 252 attached to the monitor platform 270. More preferably, there are washers 254, 258, 262, 266 on either side of both bearings 256, 264, and the washers 254, 258, 262, 266 preferably are made from nylon or Teflon. The bearings 256, 264 allow the monitor platform 270 to rotate relative to the base 260 and thus the platform 100. The hub 268 may include a partial housing 268' to provide protection for the lower bearing 264 and any accompanying washers 262, 266 as illustrated, for example, in FIGS. 3 and 12(*b*). Possible bearings include, for example, thrust bearings, steel ball thrust bearings, steel tapered-roller bearings, a rolling bearing, and a lazy susan bearing. Most preferably, the bearings are a steel needle-roller thrust bearing. Instead of bearings other possible materials capable of allowing the relative rotation may be used. Alternatively, the bearings 256, 264 respectively may be countersunk into the base 260 and/or the monitor platform 270 to reduce the height of this particular accessory clip 250. If the upper bearing 256 is countersunk into the monitor platform 270, then a low resistance (if not non-friction) coating could be applied to the cavity formed in the monitor platform to reduce friction with the possible elimination of the disc 252. Likewise, if the lower bearing 264 is countersunk into the base 260, a low resistance (if not non-friction) coating could be applied to that cavity and the hub 268 and the bolt 269 could possibly be omitted.

Alternatively, the monitor accessory clip 250 may include a locking system 290 capable of engaging holes 292 around the periphery of both bearings 256, 264 as illustrated, for example, in FIG. 6(*b*)-(*c*). The locking system 290 preferably is offset from the tabs 200, 200 of this accessory clip 250, and more preferably the locking system 290 passes through another hole 121*b* separate from the tabs 200, 200. More preferably, the locking system 290 is a pressure driven ball bearing system, a spring plunger, or a spring loaded ball bearing that pushes vertically into a respective hole. Most preferably, the locking system 290 will include a plunger mechanism responsive to the user applying a downward force to rotate the monitor platform between locking positions. The locking system preferably allows for locking the monitor platform at multiple fixed positions. Preferably, the positions include positions at 0°, 90°, 180°, and 270°. Alternatively, the positions may be spaced at 45° intervals or any other intervals that are desired. Another alternative is that the positions might be spaced at 15° or 30° intervals; however, any interval could be created with appropriate spacing of the holes.

Alternatively, the monitor accessory clip may include a pair of straps that fit over a monitor placed on the monitor accessory clip as illustrated, for example, in FIG. 6(*a*). Each pair of straps includes two straps 282, 284 that have one end connected (or attached) to the edge of the monitor platform 270, which may include vertical walls 272 that frame all or a portion of the monitor platform 270. The two straps preferably include one strap 282 with a cinch ring (or an eyelet) 2822 for passing the other strap 284 of the pair through it to allow for tightening the straps together to hold the monitor 900 on the monitor platform 270. The second strap 284 preferably will include Velcro to hold the strap pair and the monitor 900 in a set position once tighten. Alternatively, the first strap and/or the second strap may include a length adjustment cinch ring (or buckle).

Another possible accessory clip 300 provides an attachment for an infusion pump 910 as illustrated, for example, in FIGS. 7(*a*)-(*c*). This accessory clip 300 preferably allows for the attachment of an infusion pump 910 in multiple different positions. This accessory clip 300 preferably includes at least one connector 205, a base 302, two upright members 304, 306, and a mount 308. The base 302 preferably is attached to the bridge 214 of the connector 205; alternatively the base 302 may be attached to the tab 210. If there is one connector 205, then the base 302 preferably is centered about the connector 205. If there are two connectors 205, then preferably the connectors 205 are spaced at opposite ends of the base 302, which preferably will also serve as the tab 210 or 210' for this accessory clip. Preferably, the mount 308 runs between the two upright members 304, 306, which extend up from the base 302. Alternatively, the two upright members 304, 306 may include stops 310 or 312 to assist in the angling of the infusion pump 910 relative to the platform 100 as illustrated, for example, in FIGS. 7(*d*) and 12(*a*), respectively. Alternatively, the connector 205 may be replaced with a pair of tabs 200, 200.

The accessory clip 350 illustrated, for example, in FIGS. 8(*a*)-(*b*) provides an attachment for a ventilator 920, suction unit, other cylindrical devices, or any other equipment prone to be attached using straps 360, 362. This accessory clip 350 preferably includes a pair of tabs 200, 200, a base 352, and at least one pair of straps 360, 362. The straps 360, 362 preferably are attached to opposite sides of the base 352. The straps 360, 362 preferably are similar to the straps described in connection with the monitor accessory clip 250.

Another possible accessory clip 400 for attaching a ventilator 925, particularly an Impact Instrumentation, Inc. (West Caldwell, N.J., U.S.A.) Model No. 754, is illustrated in FIGS. 9(*a*)-(*b*). This accessory clip 400 preferably includes a pair of tabs 200, 200, a base 405, and a rail mount (or dove tail mount) 410. The rail mount 410 preferably extends up from the base 405 and includes a pair of parallel rails 412, 414. Each of the rails 412, 412 preferably includes a piece 414 that extends up and a horizontal piece 416 that extends towards the opposing rail 412 and is parallel to the base 405 as illustrated in FIG. 9(*a*). Alternatively, a knob or other tightening mechanism 420 may pass through the base 405 such that it is able to communicate with a ventilator 915 that has been slid into the rails 412, 412 to provide a better connection between the accessory clip 400 and the ventilator 915 as illustrated in FIG. 9(*a*). A further alternative is to replace the pair of tabs with at least one connector such that the ventilator can be mounted vertically on the platform.

Another possible accessory clip 450 is illustrated, for example, in FIGS. 10(*a*)-(*b*) and is for connecting an IV bag, blood bag and/or other type of fluid bag or anything else that would be benefited from being elevated above both the patient and the platform. This accessory clip 450 preferably includes a connector 205 connected to a pole 455 having at least one hook 460 at the top of the pole 455. The hook 460 preferably loops around to provide a horizontal component at its top as illustrated in FIG. 10(*b*). Alternatively, there may be two hooks 460, 460 on opposing sides of the pole 455 as illustrated in FIG. 10(*b*). More preferably for the alternative embodiment is that the hooks 460, 460 extend out from the pole 455 parallel to the side of the platform 100 that the pole 455 is attached to.

Another possible accessory clip 500 is for attaching an oxygen (or other gas) bottle 930 or cylindrical object to the platform 100 as illustrated, for example, in FIG. 11. This accessory clip 500 preferably includes a pair of gussets. Each gusset preferably includes a connector 205 with a cantilever 510 extending out from the connector 205 with a clamp 520 extending up from the cantilever 510. More preferably, the cantilever 510 is channeled away from the clamp 520 to increase its respective strength. The clamp 520 preferably includes a pair of bases 522 with an O-ring shape clamp 524 setting on the pair of bases 522. Examples of clamps that will work for this application are ones manufactured by Clampco Products, Inc. (Wadsworth, Ohio, U.S.A.). Alternatively, the clamp could have any cross-section to fit a variety of objects such as objects with rectangular, square or oval cross-sections.

Another accessory clip 550 is a pair of straps for holding a box (or rectangular) shaped medical equipment such as a Life Pak 940 as illustrated, for example, in FIGS. 17(*a*)-(*b*). Each of the pair of straps preferably includes two straps 560, 570 each with an accessory pin 190 attached with a ring 552 to the strap 560, 570 for attaching that end to one of the side holes 118 of the platform 100. The pair of straps otherwise preferably are similar to those described in connection with a few of the alternative embodiments of the monitor accessory clip 250. More particularly, the strap 560 includes a buckle 562 to adjust the strap length and a cinch ring 564, and the strap 570 preferably includes Velcro. These pair of straps may also be used to hold the legs 150 in a folded position for storage to minimize the amount of storage space needed to store the invention. An alternative embodiment of the platform includes larger holes along the sides for heavier duty accessory pins to be used in conjunction with the straps 560, 570. In this alternative embodiment, the remaining holes along the sides of the platform are for the accessory pins being used in conjunction with the other accessory clips.

Another accessory clip 600 includes multiple attachments for different pieces of medical equipment. An example of this is illustrated, for example, in FIGS. 1 and 12(*a*)-(*b*), which shows an accessory clip 600 with a monitor mount 250', a ventilator strap mount 350', and an infusion pump mount 300'. This accessory clip 600 preferably includes four tabs 200 at its corners attached to the platform with accessory pins 190, more preferably two tabs at both ends that are parallel to side walls 114. The accessory clip 600 illustrated in FIG. 12(*a*) also shows a different hole setup for the support surface 110 of the platform 100 that in the illustrated set-up allows for two positions for the illustrated accessory clip 600.

FIG. 13 illustrates a modification to the above embodiment where the accessory clip 600' covers most of the top of the support surface 112. This accessory clip 600 preferably includes four tabs 200 at its corners attached to the platform with accessory pins 190, more preferably two tabs at both ends that are parallel to side walls 114. This illustrated embodiment includes the rail ventilator mount 400'. The illustrated embodiment also shows an alternative oxygen bottle mount 500' that has the cantilever 510 extending in the vertical direction. FIG. 13 also illustrates this accessory clip 600' with a set of medical equipment filling the available mounts 250', 300', 400'.

FIGS. 13 and 14 illustrate an alternative mounting arrangement for the oxygen bottle accessory clip 500' that replaces the connector 205 with a clamping mechanism 530. The clamping mechanism 530 preferably includes a horizontal member 532 through which a tightening mechanism 534 passes through such as a screw with a flat plate or end for applying pressure on the top of the support surface 110 of the platform 100. The bottom of the clamping mechanism 530 preferably includes an L-shaped member 536 that goes under the side wall 114 or 116 of the platform 100 such that the platform side wall 114 or 116 fits between the cantilever 510 and the vertical member 5362 of the L-shaped member 536. Alternatively, the screw 534 could apply pressure from below the support surface 110. Alternatively, this clamping mechanism 530 may also be used in place of the connector 205 on other accessory clips. A further alternative is that the cantilever is a pair of members that having a variable connection such that the length of the cantilever may be adjusted to fit different sized cylinders with the clamp being capable also of fitting a variety of sized cylinders.

As illustrated, for example, in FIGS. 4, 15, and 18(*a*)-(*b*), each of the legs 150 preferably includes a leg connected to the platform with a hinge 128 and a hooking mechanism 160 that is connected to the leg 150 such that it may move about the connection between the leg 150 and, the hooking mechanism (or securing mechanism) 160. The leg 150 preferably includes at least one footing 152 that is capable of resting on top and/or against the pole of a litter. More preferably, there are two footings 152, 152, which if side walls 116 are present on the long sides of the support surface 110 and the footings 152, 152 are spaced apart a distance about the width of the support surface 110, then preferably there are cutouts 1522 on the footings 152, 152 such that footings 152, 152 will not interfere with the leg 150 being folded up under the support surface 110.

The hooking mechanism 160 preferably includes at least one hook 162 and a locking mechanism 170 to lock the hook 162 about the pole of the litter as illustrated, for example, in FIG. 4. More preferably, the hooking mechanism 160 includes two hooks 162, 162 connected with a crossbar 164 that then connects with a pair of poles 166, 166 attached to respective locking mechanisms 170, which are preferably connected by a handle 168, as illustrated, for example, in FIG. 18(*b*). However, in an alternative embodiment there may be just one pole 166 and one locking mechanism 170 with no handle 168.

The locking mechanism (or latching mechanism) 170 preferably is a cam lock. Each of the cam locks may be a draw latch such as a blade draw latch, lever draw latch, or a compression spring draw latch; or an adjustable draw latch such as enclosed push latches, expose pull latches or padlocking exposed pull latches. FIGS. 18(*b*) and 19 illustrate the most preferred structure for the locking mechanism 170. The locking mechanism 170 preferably includes a locking piece 172, a lever 174, and a bracket 176. The locking piece 172 flips up and engages a strike 178 (shown in FIG. 3) as illustrated, for example, in FIG. 19. The lever 174 then is flipped up to push locking piece 172 downward within bracket 176 to hold the locking mechanism 170 in place respective to the strike 178 as illustrated, for example, in FIG. 18(*b*). Alternatively, the locking piece 172 and the strike 178 may be formed as a unitary piece (not shown).

Alternatively, each of the legs may include at least one stabilizing mount (or securing mechanism) 180 in place of the hooking mechanism 160 as illustrated, for example, in FIGS. 3 and 12(*a*). A similar cam locking mechanism 170 is preferably used to lock in place the stabilizing mount 180. In this alternative embodiment, the legs 150, 150 each have two pairs of mounts, or alternatively one pair of mounts may be used per side of the table. Each pair of mounts includes the footing 152 and one stabilization mount 180 that both preferably are tapered to fit the poles of a litter as illustrated, for example, in FIG. 3. Each pair of mounts also preferably includes a strike 178 and a locking mechanism 170 attached to the stabilization mount 180 for engaging the strike 178. Preferably, the locking mechanism 170 slides with the stabilization mount 180 along a slot 182 for engaging litter poles or for storing of the device if at least one catch 108 preferably is provided on the bottom of the support surface 110 for each leg 150. Alternatively, the locking mechanism 170 may be flipped with the strike such that the strike is attached to the stabilization mount and/or the support mount may slide within the slot in addition to or instead of the stabilization mount. A further alternative is that there is one footing 152 and/or stabilization mount 180 per side of the litter stand.

Another alternative embodiment is to add a mechanism to lock the leg relative to the platform. One possibility is to use a brace 800 similar to that illustrated in FIGS. 20(*a*)-(*b*). The brace preferably includes a Y-shaped member with the tops (or ends) 802, 802 of the Y attached and/or connected to the leg 150 preferably approximate to the hinge 128. Preferably, there is a support member 803 connecting ends 802, 802. The other end of the Y 804 preferably includes either a single end or a dual end with a hole 806 passing therethrough. The dual end preferably would fit about a tab 200 such that the holes 806 passing through the dual end would be able to be aligned with the hole 202 of the tab 200. Likewise, the single end would have a hole 806 such that it can be aligned with the hole 202 of the tab 200. An accessory pin 190 preferably is used to connect the brace 800 to the respective tab as illustrated, for example, in FIG. 20(*b*). When the leg 150 is folded up, the brace 800 preferably rests between the leg 150 and the support surface 110.

Another possibility for locking the leg 150 relative to the support surface 110 is at least one butterfly lock (or a lift and turn draw latch) 820, which is locked in place by turning the flip up handle either clockwise or counterclockwise and the reverse to unlock. The butterfly lock 820 preferably crosses on the outside over the hinge 128 as illustrated in FIGS. 2 and 4.

A third possibility for locking the leg 150 in place is a sleeve 840 that covers the hinge 128 when the leg 150 is in place for use as illustrated, for example, in FIGS. 21(*a*)-(*b*). The sleeve 840 may replace or be in addition to the hinge 128. The sleeve 840 preferably includes an internal ridge (or rim) for engaging a corresponding ridge (or rim) 1142 around the lower end of wall 114, 114 to prevent the sleeve 840 from sliding down the leg 150. The sleeve 840 preferably slides up so that the leg 150 may be folded underneath the support surface 110.

Another alternative embodiment for the leg 150 is a height adjustment feature, which will be referred to as a means for adjusting the height of the supporting and positioning means relative to the litter. Preferably, the height adjustment feature is accomplished with each leg preferably having at least two pairs of height holes 862 along at least one slot 864. More preferably, there are three pairs of height holes and two slots as illustrated, for example, in FIGS. 18(*b*) and 22(*a*)-(*c*). The slots 864, 864 preferably allow a slide piece (or slider) 866 to slide the length of the slots 864, 864 for height adjustment of the litter stand on a litter. The slide piece 866 preferably connects the support piece 154 to the hooking mechanism 160, which preferably are on opposite sides of the leg 150. The slide piece 866 may for example be a spacer(s), a washer(s), a nut(s), a bolt(s), or some combination of these items. The slide piece 866 preferably attaches either to the handle 168 or the locking mechanism 170 of the hooking mechanism 160. The slide piece 866 preferably attaches to the support piece 154 that includes a crossbar 156 that connects the footings 152, 152. The support piece 154 preferably includes a pair of holes that can be in communication with one set of the height adjustment holes. The footings 152, 152 and the crossbar 156 may be above the bottom of the leg 150, which will be outside of the litter poles, particularly if the leg has a T-shape as illustrated, for example, in FIG. 22(*a*). The crossbar 156 preferably includes a pair of holes 1562 to be aligned respectively with the height holes 862 such that accessory pins 190 may secure the height. More preferably, the holes in the crossbar 156 are countersunk.

FIGS. 18(*a*)-(*b*) illustrate another alternative embodiment for the leg is to include a pair of cutouts 151, 151 towards the top end of the leg 150 to allow for the belt on particular vehicles such as a Blackhawk helicopter to secure the litter to prevent it from moving about the vehicle during travel. This cutout 151 comes in particular use when used in conjunction with the height adjustment feature embodiment and the leg 150 is set for its lowest position. Otherwise, the alternative embodiment of a T-shaped leg allows that same seatbelt to pass below the leg in either the preferred embodiment or in the case of the height adjustment feature alternative embodiment when the leg height is set in the bottom two pairs of holes.

Another alternative embodiment for the height adjustment feature is the inclusion of telescoping legs as illustrated in FIGS. 23(*a*)-(*b*). The legs 150*a*, 150*b* preferably are held together with a screw or other similar locking mechanism 1502 that passes through a respective slot 1504 in each of the legs 150*a*, 150*b*. The leg 150*a* may be on the outside of leg 150*b* as illustrated in FIG. 23(*a*), or the legs 150*a*, 150*b* may be reversed as illustrated in FIG. 23(*b*). Additionally, there may be multiple screw elements 1502 for each leg pair 150*a*, 150*b*.

A still further alternative embodiment is to have a variable length for the support surface to allow the platform to be fitted to different width patient carrying devices. Preferably, this would be accomplished using a slide mechanism similar to that described above in connection with slide height adjustment for the legs.

Another alternative embodiment is to add a handle 102 to an embodiment that includes at least one side wall 116 running across the litter as illustrated, for example, in FIG. 3. The handle 102 preferably would be placed in the center of the length of one side wall 116 to facilitate transport of the invention when reduced for storage. A further alternative is to line that handle 102 with foam, rubber, cloth, or other soft material. Another alternative embodiment adds a handle 102' through the support surface 110 as illustrated, for example, in FIG. 5.

Another alternative embodiment is to have interchangeable footings for different type of patient carrier apparatuses. Examples are a curve insert as described above for use with pole litters and a square insert for use with gunneries or other patient carrying devices that might have square pipe for the support skeleton. Other types of inserts are possible. Preferably, these inserts would be held in place by a plunger mechanism, screw mechanism, or an accessory pin. Alternatively, the footing could be designed to have the particular insert as a unitary piece to fit certain type of patient carrying devices.

A further alternative embodiment is to remove excess material from the platform to reduce the weight of the overall platform as illustrated, for example, in FIG. 1. Or alternatively, the two legs of the platform may instead be four legs with no material filling in the area between them similar to legs on a chair.

Another alternative embodiment connects paired accessory pins 190, 190 together with a lanyard (or cord, elastic material) 196 connecting the pair together, illustrated for example in FIG. 11, or connecting 1962 an individual accessory pin 190 to a particular accessory clip 400, illustrated for example in FIG. 9(*a*). The lanyard 196 prevents the accessory pin(s) 190 from being displaced from a particular accessory clip. Also, in the case of the oxygen bottle accessory clip 500 the accessory pins 190, 190 may be connected to each other and thus with a pull of the lanyard 196, the accessory pins 190, 190 come free from their respective holes and the oxygen bottle accessory clip 500 may be removed as illustrated, for example, in FIG. 11.

Another alternative embodiment adds a pair of support mechanisms 700, 750 for attaching a cylinder object to the litter that are similar to the oxygen bottle accessory clip 500. FIGS. 24(*a*)-(*b*) illustrate this pair of support mechanisms. The support 700 preferably includes an O-ring clamp 710 mounted on a bracket piece 720 similar to the mounts present on the litter stand. At the bottom of the bracket piece 720 there preferably is a swing arm (or cantilever) 730 that engages a litter stirrup and/or the litter stand. The support 750 preferably includes an O-ring clamp 760 on a bracket piece 770 similar to the oxygen bottle accessory clip 500 present on the litter stand. At the bottom of the bracket piece 770 there preferably is a swing arm 780 that engages the litter stand and/or a second litter stirrup. FIG. 24(*b*) illustrates the swing arm 780 positioned for attachment to a litter. Preferably, the swing arms 730 and 780 are of different lengths such that a large oxygen bottle may be attached to the litter. The bracket pieces 720 and 770 preferably are shaped to fit over a litter pole and hold the oxygen bottle snug to the litter. FIG. 24(*c*) illustrates a modified bracket 720' that may be used instead of brackets 720 and/or 770.

A still further alternative embodiment for the accessory clip is to replace the medical device interface member with a flat writing surface and/or an extension piece that may be pulled out for extra surface area. A further modification would be to include a clip or other attachment means for holding medical records relating to the particular patient on the litter that the litter stand is attached to at that time. Or instead, the medical device interface member may be a hook or clip on which a medical chart is attached. A still further alternative embodiment is to have the medical device interface member be a tray, and more specifically a tray capable of being sterilized for use as a sterile field tray.

VI. INDUSTRIAL APPLICABILITY

This invention is useful in the transport of patients from their location where the health problem or injury occurred to a location for treatment and care. An example of this is transporting a wound individual from the battlefield to medic station on to more substantial medical facilities while allowing the needed medical equipment to be transported along with the patient without causing harm to the patient or requiring a third individual to assist in the moving of the patient. The above described embodiments provide for a wide variety of flexibility in the medical equipment that is carried along with a litter thus allowing the caregiver's to select the medical equipment that will most likely be needed while leaving behind the medical equipment not likely to be needed. Additionally, the invention provides for storage of the accessory clips in an upside down orientation relative to the support surface by flipping the platform over, aligning the tab holes of the accessory clip with the tab holes of the support surface, and inserting the appropriate number of accessory pins.

The preferred and alternative embodiments described above may be combined in a variety of ways with each other. Furthermore, the dimensions, shapes, sizes, and number of the various pieces illustrated in the Figures may be adjusted from that shown.

Although the present invention has been described in terms of particular preferred and alternative embodiments, it is not limited to those embodiments. Alternative embodiments, examples, and modifications which would still be encompassed by the invention may be made by those skilled in the art, particularly in light of the foregoing teachings.

Those skilled in the art will appreciate that various adaptations and modifications of the preferred and alternative embodiments described above can be configured without departing from the scope and spirit of the invention. Therefore, it is to be understood that, within the scope of the appended claims, the invention may be practiced other than as specifically described herein.

I claim:

1. An accessory clip for use with a litter stand comprising:
a base,
at least one tab depending from said base, each of said at least one tab having an opening passing therethrough, and
at least one medical device interface member connected to said base, said medical device interface member includes
a monitor platform,
a disc in communication with said platform,
a first bearing,
a first washer in communication with said disc and said first bearing,
a second washer in communication with said first bearing and said base,
a second bearing,
a third washer in communication with said base and said second bearing,
a hub,
a fourth washer in communication with said second bearing and said hub, and
a bolt passing through and in communication with said second bearing, said base, and said first bearing, said bolt connected to said hub and said disc.

2. The accessory clip according to claim 1, wherein said platform includes a plurality of straps adapted for holding a monitor on said monitor platform.

3. The accessory clip according to claim 1, further comprising
at least one lanyard attached to said base, and
an accessory pin attached to each of said at least one lanyard.

4. An accessory dip for use with a litter stand comprising:
a base,
at least one tab depending from said base, each of said at least one tab having an opening passing therethrough, and
at least one medical device interface member connected to said base, said medical device interface member includes
a monitor platform,
a disc in communication with said platform,
a first bearing,
a second bearing,
a hub,
a bolt passing through and in communication with said second bearing, said base, and said first bearing, said bolt connected to said hub and said disc, and
a locking system having
a plurality of holes passing through said disc, and
a plunger mechanism for communicating with one of said plurality of holes.

5. The accessory clip according to claim 4, wherein said platform includes a plurality of straps adapted for holding a monitor on said monitor platform.

6. The accessory clip according to claim 4, further comprising
at least one lanyard attached to said base, and
an accessory pin attached to each of said at least one lanyard.

7. An accessory clip for use with a litter stand comprising:
a base,
at least one tab depending from said base, each of said at least one tab having an opening passing therethrough,
at least one medical device interface member connected to said base, said medical device interface member includes
a monitor platform,
a disc in communication with said platform,
a first bearing,
a second bearing,
a hub, and
a bolt passing through and in communication with said second bearing, said base, and said first bearing, said bolt connected to said hub and said; and
at least one lanyard attached to said base, and
an accessory pin attached to each of said at least one lanyard, said accessory pin capable of engaging one of the said at least one tab through the opening of said tab.

8. The accessory clip according to claim 7, wherein said medical device interface member further includes
a first washer in communication with said disc and said first bearing,
a second washer in communication with said first bearing and said base,
a third washer in communication with said base and said second bearing, and
a fourth washer in communication with said second bearing and said hub.

9. The accessory clip according to claim 7, wherein said platform includes a plurality of straps adapted for holding a monitor on said monitor platform.

10. The accessory clip according to claim 7, wherein said medical device interface member further includes a locking system having
a plurality of holes passing through said disc, and
a plunger mechanism for communicating with one of said plurality of holes.

11. The accessory clip according to claim 7, wherein said medical device interface member further includes a pair of straps with each strap attached to opposite ends of said base.

* * * * *